US012420153B2

(12) United States Patent
Barksdale et al.

(10) Patent No.: US 12,420,153 B2
(45) Date of Patent: Sep. 23, 2025

(54) SHAFT FOR GOLF CLUB

(71) Applicant: Acushnet Company, Fairhaven, MA (US)

(72) Inventors: Dustin A. Barksdale, San Marcos, CA (US); Donald S. Bone, Escondido, CA (US); Charles E. Golden, Encinitas, CA (US); Noah de la Cruz, San Diego, CA (US); Steven Scott Ogg, Carlsbad, CA (US); Parker Rosquist, Vista, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 940 days.

(21) Appl. No.: 17/562,905

(22) Filed: Dec. 27, 2021

(65) Prior Publication Data

US 2023/0173352 A1 Jun. 8, 2023

Related U.S. Application Data

(63) Continuation-in-part of application No. 17/544,033, filed on Dec. 7, 2021, now Pat. No. 12,179,076.

(51) Int. Cl.

| | |
|---|---|
| ***A63B 53/10*** | (2015.01) |
| ***A63B 53/02*** | (2015.01) |
| ***A63B 53/04*** | (2015.01) |

(52) U.S. Cl.

CPC ..... *A63B 53/10* (2013.01); *A63B 53/0433* (2020.08); *A63B 53/0437* (2020.08); *A63B 53/0466* (2013.01); *A63B 53/023* (2020.08); *A63B 2225/01* (2013.01)

(58) Field of Classification Search

CPC ..... A63B 53/10; A63B 53/12; A63B 53/04; A63B 53/0408; A63B 53/0433; A63B 53/0437

USPC ..... 473/316, 318, 319, 320, 321

See application file for complete search history.

(56) References Cited

U.S. PATENT DOCUMENTS

| | | | | |
|---|---|---|---|---|
| 5,935,020 | A | 8/1999 | Stites | |
| 7,318,780 | B2 * | 1/2008 | Oyama | A63B 60/00 473/319 |
| 8,128,508 | B2 * | 3/2012 | Sato | A63B 53/10 473/319 |
| 8,177,659 | B1 | 5/2012 | Ehlers | |
| 8,337,336 | B2 * | 12/2012 | Brekke | G06F 17/00 473/316 |
| 8,535,174 | B2 * | 9/2013 | Brekke | G01N 19/00 473/409 |

(Continued)

OTHER PUBLICATIONS

Office Action for copending U.S. Appl. No. 17/544,033 mailed Mar. 7, 2024, 16 pages.

(Continued)

*Primary Examiner* — Joseph B Baldori

(74) *Attorney, Agent, or Firm* — Womble Bond Dickinson (US) LLP

(57) ABSTRACT

Golf clubs with improved aerodynamic properties. In an example, a golf club has a golf club head; a grip; and a shaft having a tip end and a butt end. The golf club head is coupled to the shaft at the tip end, and the grip is coupled to the shaft (Continued)

at the butt end. An average bending stiffness of a butt end portion of the shaft is greater than 3.70 times an average bending stiffness of a tip end portion of the shaft.

19 Claims, 24 Drawing Sheets

(56) References Cited

U.S. PATENT DOCUMENTS

| | | | | |
|---|---|---|---|---|
| 8,568,247 | B1 | 10/2013 | Ehlers | |
| 8,758,157 | B1 | 6/2014 | Ehlers | |
| 8,784,234 | B2 | 7/2014 | Lacey | |
| 8,827,828 | B2 * | 9/2014 | Brekke | A63B 53/00 473/409 |
| 9,387,378 | B2 * | 7/2016 | Shimono | A63B 60/00 |
| 9,433,833 | B2 | 9/2016 | Ehlers | |
| 9,566,486 | B2 * | 2/2017 | Griffith | A63B 53/12 |
| 10,080,940 | B2 * | 9/2018 | Brekke | G01N 19/00 |
| 10,213,666 | B1 * | 2/2019 | Adams | A63B 53/12 |
| 11,247,105 | B2 | 2/2022 | Beach | |
| 2002/0082111 | A1 * | 6/2002 | Hedrick | A63B 60/00 473/316 |
| 2010/0016097 | A1 | 1/2010 | Albertsen | |
| 2010/0041492 | A1 * | 2/2010 | Rice | A63B 53/00 473/316 |
| 2011/0136584 | A1 | 6/2011 | Boyd | |
| 2012/0316007 | A1 | 12/2012 | Burnett | |
| 2013/0231201 | A1 * | 9/2013 | Matsunaga | A63B 53/10 473/319 |
| 2014/0066224 | A1 | 3/2014 | Albertsen | |
| 2017/0021236 | A1 | 1/2017 | Ghods | |
| 2017/0043222 | A1 * | 2/2017 | Stokke | A63B 53/0466 |
| 2018/0200586 | A1 | 7/2018 | Stites | |
| 2019/0001198 | A1 | 1/2019 | Burnett | |
| 2022/0111266 | A1 | 4/2022 | Henrikson et al. | |

OTHER PUBLICATIONS

Covey, Tony, COBRA LTDx Drivers, MyGolfSpy.com, Jan. 19, 2022, retrieved on May 11, 2022, https://mygolfspy.com/cobra-ltdx-drivers/.

* cited by examiner

| Club Head Number | $H_{RC}$ (mm) | $H_{RS}$ (mm) | $T_{Rear}$ (mm) | $L_{FB}$ (mm) | $\Phi_{1/2}$ | $\Phi_{1/3}$ | $\theta_{1/2}$ | $\theta_{1/3}$ |
|---|---|---|---|---|---|---|---|---|
| Example 1 | 36.4 | 19.6 | 17 | 112.9 | 24.3 | 29.4 | 17 | 18.5 |
| Example 2 | 36.4 | 22.8 | 13.7 | 112.9 | 24.3 | 29.4 | 19.9 | 22.6 |
| Example 3 | 36.4 | 26.2 | 10.3 | 112.9 | 24.3 | 29.4 | 22.6 | 26.5 |
| Example 4 | 30.1 | 13.2 | 17 | 112.8 | 28 | 32 | 11.3 | 12.2 |
| Example 5 | 30.1 | 16.4 | 13.8 | 112.8 | 28 | 32 | 13.7 | 13.9 |
| Example 6 | 30.1 | 19.7 | 10.5 | 112.8 | 28 | 32 | 16.7 | 18.1 |
| Example 7 | 42.7 | 26.1 | 16.8 | 112.8 | 19.4 | 24.3 | 22.8 | 25.9 |
| Example 8 | 42.7 | 29.4 | 13.5 | 112.8 | 19.4 | 24.3 | 25.4 | 29.7 |
| Example 9 | 42.7 | 32.6 | 10.3 | 112.8 | 19.4 | 24.3 | 27.9 | 33 |
| Example 10 | 37.4 | 19.6 | 17 | 113.4 | 24.4 | 29.5 | 17 | 18.5 |

FIG. 10

| EI Profile Tipping | Name | Shaft Type | Weight | Flex | Club | Balance Point Pct | Torque | Base Frequency | Tip Frequency |
|---|---|---|---|---|---|---|---|---|---|
| none | Shaft A | Driver | 57.72 | XX | | 45.1 | 4.9 | 238 | 663 |
| none | Shaft B | Driver | 67.6 | X | | 47.4 | 3.3 | 286 | 866 |
| none | Shaft C | Driver | 64.1 | S | | 47.3 | 3.3 | 274 | 843 |

FIG. 16

Example 1 Golf Club vs Example 2 Golf Club

| EI Profile Tipping | Name | Shaft Type | Weight | Flex | Club | Balance Point Pct | Torque | Base Frequency | Tip Frequency |
|---|---|---|---|---|---|---|---|---|---|
| none | Example 1 golf club | Driver | 55.93 | S | | 48 | 5.3 | 272 | 852 |
| 1'' | Example 2 golf club | Driver | 47.27 | S | | 48.5 | 5.6 | 267 | 807 |

FIG. 24

Light Shaft / Light Grip Player Testing Results

| | Ball Speed | Direction | Launch | Spin |
|---|---|---|---|---|
| Example 2 golf club vs Example 1 golf club (A1 Setting) | 36% (+1.4mph) (+.4mph average) | 29% (Right 12 yds) (3.7 yds right average) | 29% (+.9°) (+.2° average) | |
| Example 2 golf club (light grip) vs Example 1 golf club (A1 Setting) | 27% (+1.7mph) (+.6mph average) | 36% (Left 11 yds) (5.5 yds left average) | 45% (-1.7°) (-.7° average) | 27% (-360rpm) (-146rpm average) |
| Example 2 golf club (light grip, B1 setting) vs Example 1 golf club (A1 Setting) | 44% (+1.7mph) (+.4mph average) | (.8 yds right average) | 28% (-.8°) (-.25° average) | 28% (-280rpm) (-76rpm average) |

FIG. 25

SHAFT FOR GOLF CLUB

CROSS-REFERENCE TO RELATED APPLICATIONS

This application is a continuation-in-part of U.S. patent application Ser. No. 17/544,033, filed Dec. 7, 2021, which is hereby incorporated by reference in its entirety. To the extent appropriate, the present application claims priority to the above-reference application.

BACKGROUND

During the game of golf, a golfer may often desire to hit a golf ball further. For instance, with a driver, the golfer may desire to hit the golf ball as far as possible. One factor in the distance the golf ball travels is the club head speed of the golf club as it is being swung. As a golf club is swung by a golfer, the golf club experiences significant drag effects that require greater power from the golfer to achieve higher swing speeds. Thus, a reduction in drag of the golf club head allows for higher club head speeds with the same amount of effort from the golfer.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe improved golf clubs with improved properties that provide increased swing speeds. In an aspect, the technology relates to a golf club including a golf club head; a grip; and a shaft having a tip end and a butt end, the golf club head being coupled to the shaft at the tip end, the grip being coupled to the shaft at the butt end, and an average bending stiffness of a butt end portion of the shaft being greater than 3.70 times an average bending stiffness of a tip end portion of the shaft.

In an example, the average bending stiffness of the butt end portion of the shaft is greater than 4.20 times the average bending stiffness of the tip end portion of the shaft. In another example, the tip end portion extends in a tip-to-butt direction from 150 mm from the tip end to 300 mm from the tip end, and the butt end portion extends in the tip-to-butt direction from 800 mm from the tip end to 950 mm from the tip end. In an example, the average bending stiffness of the butt end portion of the shaft and the average bending stiffness of the tip end portion of the shaft satisfy the following inequality:

$$BS \geq 4.32TS - 64.8\ \frac{\text{kg}}{\text{in}},$$

wherein BS is the average bending stiffness of the butt end portion of the shaft, and TS is the average bending stiffness of the tip end portion. In another example, a mass of the shaft is less than 55 g, and a mass of the grip is less than 45 g. In an example, the mass of the shaft is less than 50 g, and the mass of the grip is less than 40 grams, and a mass ratio of the mass of the shaft to the mass of the grip is within a range of 1.0 to 1.5. In an example, the mass ratio is within a range of 1.1 to 1.3. In another example, a diameter of the shaft at the tip end is less than 0.315 inches.

In an aspect, the technology relates to a golf club including a golf club head; a grip; and a shaft having a tip end and a butt end, the golf club head being coupled to the shaft at the tip end, and the grip being coupled to the shaft at the butt end. The shaft includes: a tip end portion that extends in a tip-to-butt direction from 150 mm from the tip end to 300 mm from the tip end; a butt end portion that extends in the tip-to-butt direction from 800 mm from the tip end to 950 mm from the tip end and has an average rate of change of bending stiffness in the tip-to-butt direction; and a middle portion between the tip end portion and the butt end portion, a rate of change of bending stiffness in the tip-to-butt direction at a point along the middle portion being at least 2.7 times the average rate of change of bending stiffness of the butt end portion.

In an example, the rate of change of the bending stiffness at the point along the middle portion is at least 3.5 times the average rate of change of bending stiffness of the butt end portion. In another example, the middle portion extends in the tip-to-butt direction from 600 mm from the tip end to 800 mm from the tip end. In another example, a diameter of the shaft at the tip end is less than 0.315 inches. In another example, the diameter of the shaft at the tip end is less than 0.300 inches. In another example, the diameter of the shaft at the tip end is within a range of 0.250 inches to 0.285 inches. In another example, a mass of the shaft is less than 50 g, a mass of the grip is less than 40 grams, and a mass ratio of the mass of the shaft to the mass of the grip is between 1.0 to 1.5.

In an aspect, the technology relates to a golf club including a golf club head; a grip; and a shaft having a tip end and a butt end, the golf club head being coupled to the shaft at the tip end, and the grip being coupled to the shaft at the butt end, wherein a difference in bending stiffness in the shaft between a point at 800 mm from the tip end and a point at 600 mm from the tip end is at least 200 kg/in.

In an example, the difference in bending stiffness is at least 300 kg/in. In another example, a diameter of the shaft at the tip end is less than 0.300 inches. In another example, a mass of the shaft is less than 50 g, a mass of the grip is less than 40 g, and a mass ratio of the mass of the shaft to the mass of the grip is within a range of 1.1 to 1.3.

In another example, the golf club head is a metal-wood type golf club head having a club head frontmost point and a club head rearmost point. The golf club head includes: a striking face, the striking face defining the frontmost point; a sole connected to a bottom side of the striking face, the sole having a rearmost point and a closing ascent angle of less than 35 degrees; and a crown connected to a topside of the striking face, the crown including a rearmost point and a closing descent angle of less than 35 degrees. The closing ascent angle is an angle between (1) a line from the rearmost point of the sole to a sole point, of a projected silhouette of the golf club head from a toe-side viewpoint, located one third a front-to-back length from the club head rearmost point, as measured along a ground plane, and (2) a plane intersecting the sole point and parallel to the ground plane. The closing descent angle is an angle between (1) a line from the rearmost point of the crown to a crown point, of the projected silhouette of the golf club head from the toe-side viewpoint, located one third a front-to-back length from the club head rearmost point, as measured along a ground plane, and (2) a plane intersecting the crown point and parallel to the ground plane. The closing descent angle is within 85%-115% of the closing ascent angle of the sole.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

FIG. 10 depicts dimensions of example golf club heads.

FIG. 16 depicts a chart with data of three golf clubs.

FIG. 24 depicts a chart with data of two golf club shafts.

FIG. 25 depicts a chart with test ball flight data obtained from golf shots using the two golf club shafts of FIG. 24.

DETAILED DESCRIPTION

Due to the swing speeds and the shape of golf club heads, many golf clubs, or parts thereof, operate in a Reynolds number regime in which the state of the viscous boundary layer is typically laminar unless forced to a turbulent state by a tripping structure. On bluff bodies, such as the hosel of a golf club, the laminar boundary layer will separate creating a large wake with a relatively low-pressure region. This low pressure acting on the aft facing surface area results in a drag force that retards the speed of the clubhead at impact. In particular, hosels on golf clubs are often constructed having a circular (or nearly so) cross section. Circular cylinders at subcritical (prior to natural transition) Reynolds numbers have a relatively high drag coefficient as compared to those operating with a turbulent boundary layer. By forcing the transition to occur with a tripping structure the drag can be reduced with a resultant increase in clubhead speed. Due to the rotation of the golf club head, the location and dimensions of the tripping structures become important to create the transition from the laminar flow to the turbulent flow.

In addition to tripping structures on the hosel of the golf club head, the shape of the golf club head may also be altered to improve its aerodynamic properties. For instance, changing the shape of the golf club head, such as the striking face, crown, and sole, causes changes in drag experienced by the golf club head during a swing of the golf club head. As an example, what is commonly perceived as an improved aerodynamic shape to the golf club head is to have the crown and the sole meet a singular point at the aft of the golf club head, such as to form a teardrop shape of the golf club head that has a sharper trailing edge. The present technology, however, goes against that traditional perception of the teardrop shape while still lowering drag and improving the overall aerodynamic properties of the golf club head. For instance, the traditional teardrop shape causes a high closure angle of the crown and/or the sole. This high closure angle causes an earlier, or more forward, separation of the turbulent flow over the crown and the sole, which increases the pressure drag experienced by the golf club head during a swing. The present technology changes, and reduces, the closure angles of the crown and/or the sole to move the separation of the turbulent flow further towards the aft the golf club. These reduced closure angles result in a golf club head that may look less aerodynamic but actually results in a golf club that experiences less pressure drag forces and has overall improved aerodynamic properties. The changes to the closure angles of the crown and/or the sole may be accomplished, for example, by raising an aft portion of the skirt further above the ground plane and/or increasing the thickness of the aft portion of the skirt.

Figure 1:
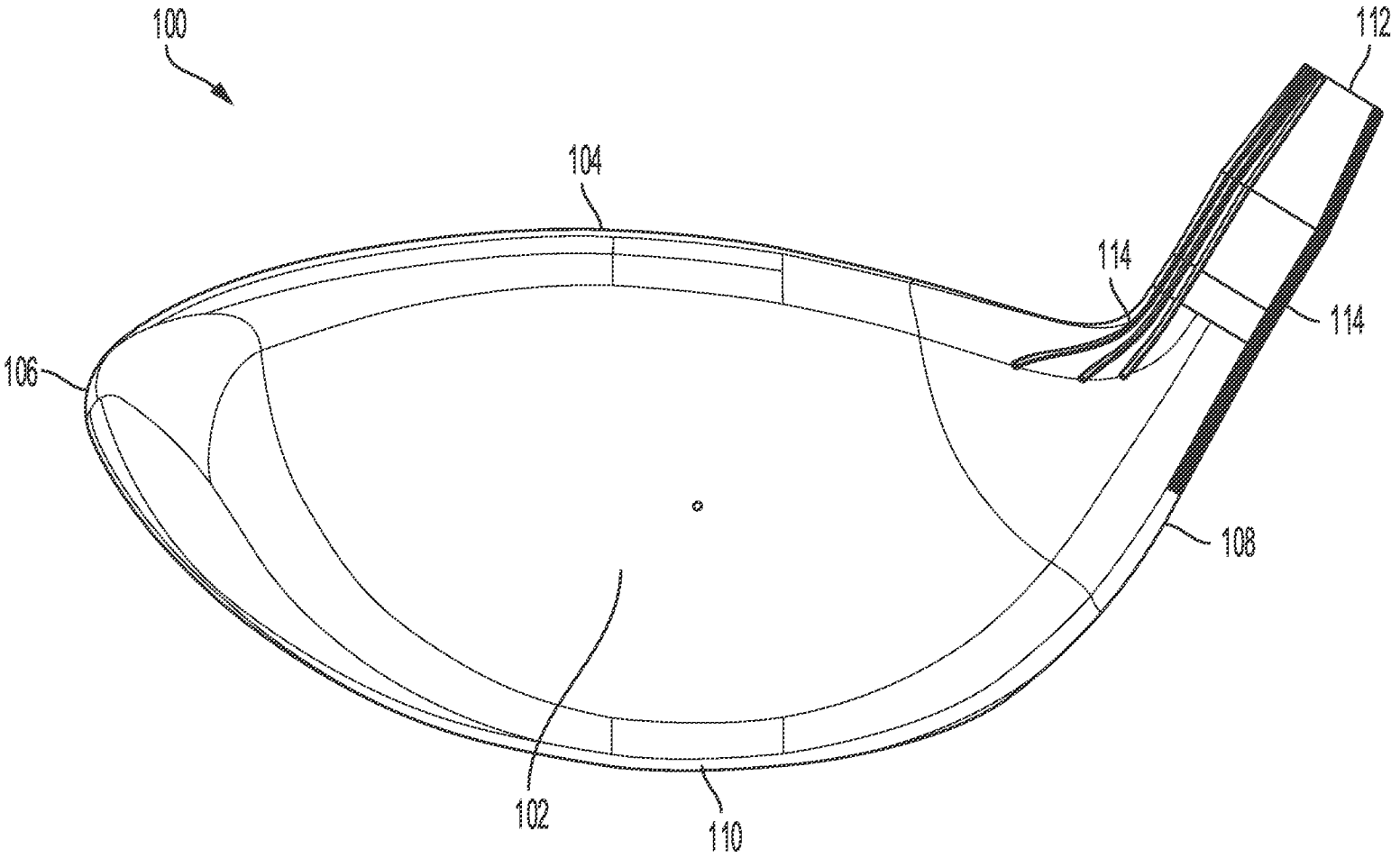
FIG. 1 depicts a front view of an example golf club head including a plurality of tripping structures.
Figure 2:
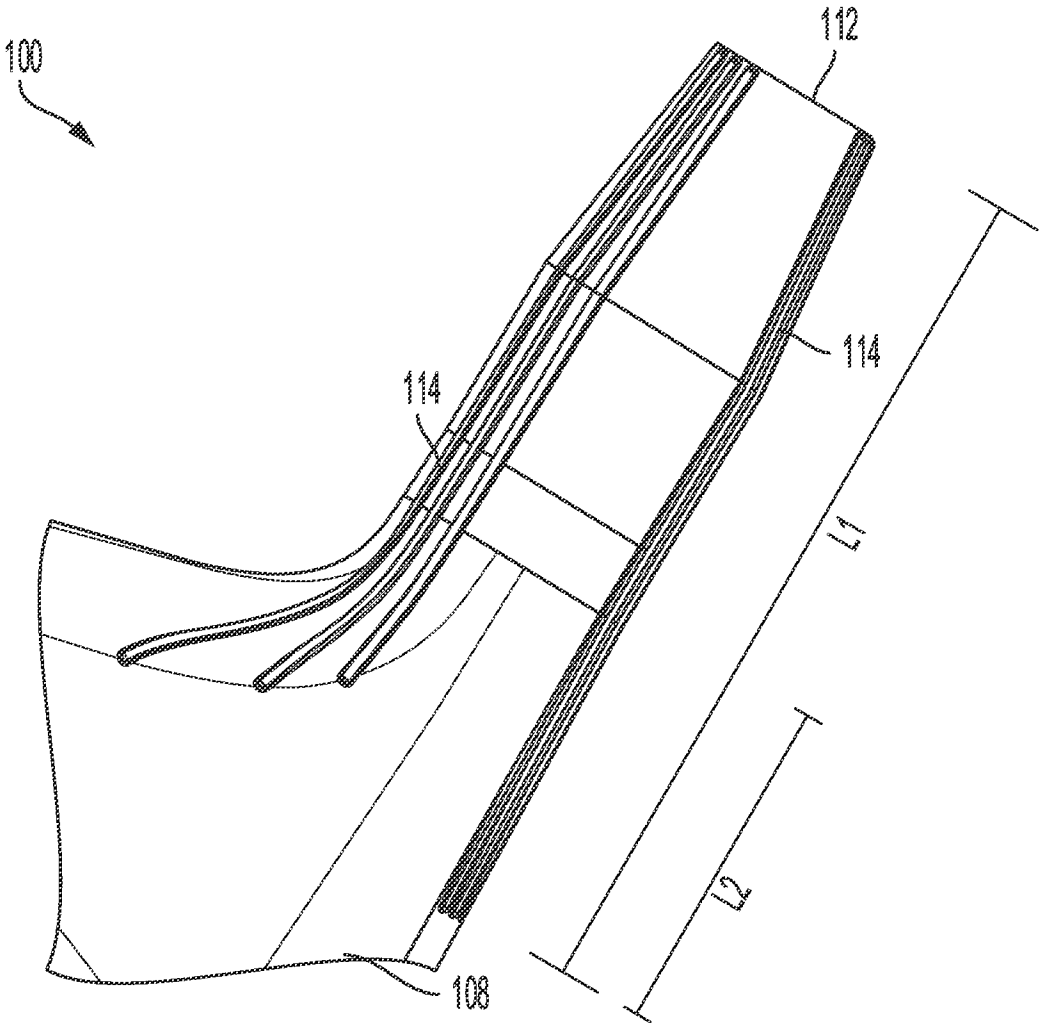
FIG. 2 depicts a front view of a hosel of the golf club head of FIG. 1.

FIG. 1 depicts a front view of an example golf club head 100 including a plurality of tripping structures 114. FIG. 2 depicts an enlarged front view of a hosel of the golf club head of FIG. 1. FIGS. 1-2 are discussed concurrently. The golf club head 100 is metal-wood type golf club head, such as a driver or a fairway metal. The golf club head 100 includes a striking face 102, a crown 104, a toe region 106, a heel region 108, and a sole 110. The crown 104 and the sole 110 may be attached to the striking face 102. For instance, the crown 104 is attached to a topside of the striking face 102 and the sole 110 is attached a bottom side of the striking face 102.

The golf club head 100 also includes a hosel 112. The hosel 112 is used to attach a shaft (not depicted) to the golf club head 100. The hosel 112 may be formed into at least a portion of the crown 104 and the heel portion 108. The hosel 112 may also include a ferrule or components of an interchangeable shaft system.

The hosel 112 also includes a plurality of tripping structures 114. In the example depicted, the tripping structures 114 are formed as elongate ridges extending from the top of the hosel towards the sole. This particular pattern has three substantially parallel ridges on both the heelward and toeward side of the hosel. The height of the ridges (e.g., the distance the ridges protrude from the surface of the hosel) may be between 0.005 inches and 0.03 inches. In some examples, the height of the ridges is between 0.009 inches and 0.015 inches.

The length (L1) of the tripping structures 114 may be between 30-70 mm. In some examples, the length (L2) of the tripping structures 114 may be greater than 40 mm. The length of the tripping structures 114 may also be considered as two components, a first length component that extends through a ferrule and any additional hosel components (e.g., adjustable shaft components, rings, sleeves, etc.) and a second length component extending across the body of the club head 100, such as the heel region 108 of the club head 100. The second length component is represented as L2 in FIG. 2, and represents the length of the tripping structures 114 across the body of the club head 100. The second length component (L2) may be between 15-35 mm, 20-30 mm, and/or may be at least 20 mm. In some examples, the heelward tripping structures and the toeward tripping structures 114 may have the same length. In other examples, the heelward tripping structures 114 may have a greater length than the toeward tripping structures 114. In yet other examples, the toeward tripping structures 114 may have a greater length than the heelward tripping structures 114.

Figure 3A:
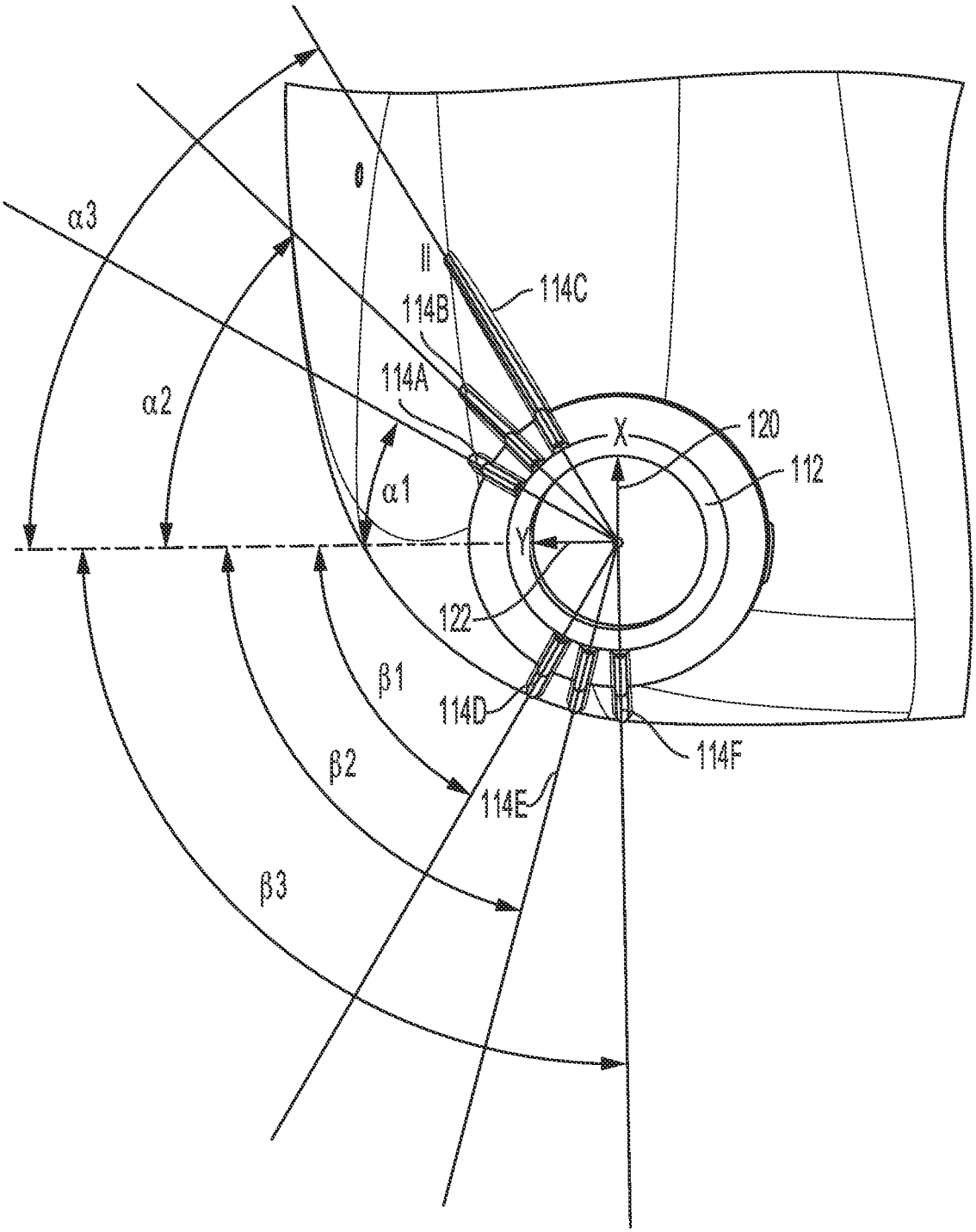
FIGS. 3A-3B depict top views of the hosel of the golf club head of FIG. 1.
Figure 3B:
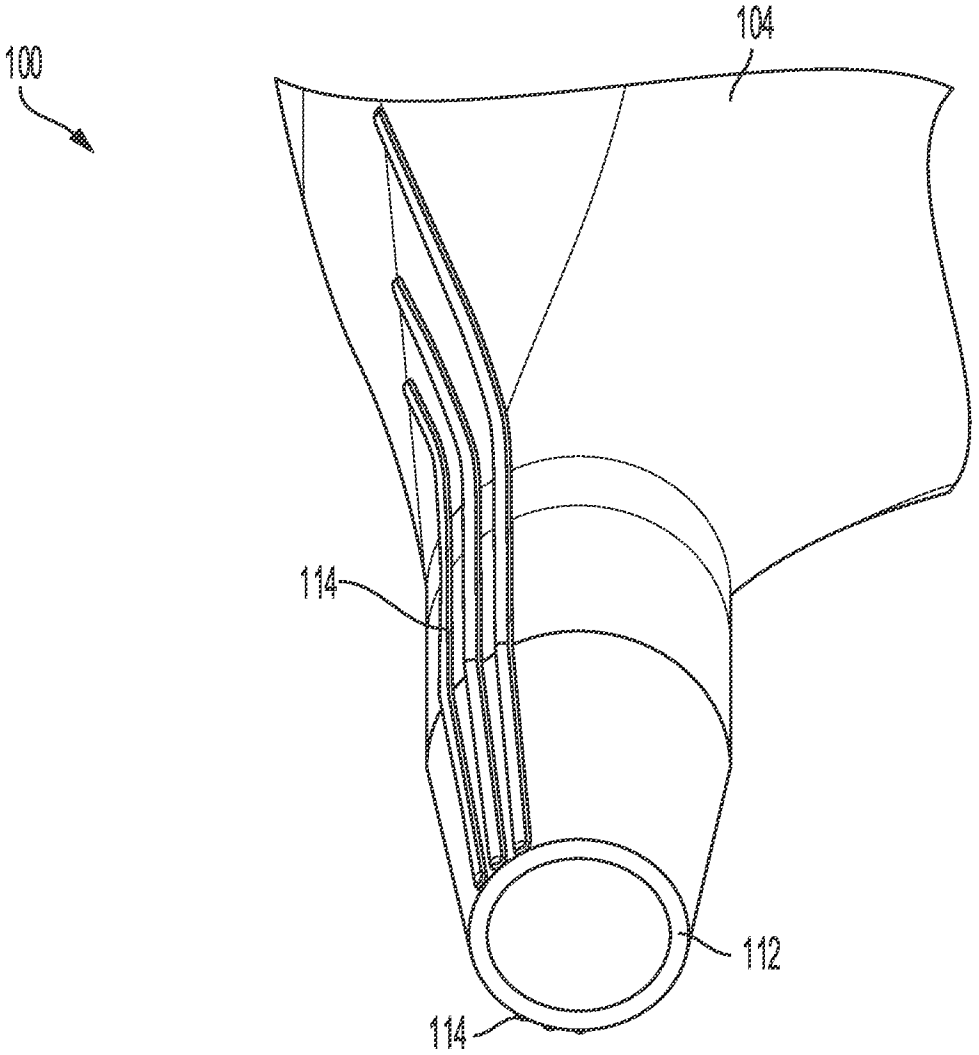
Figure 4:
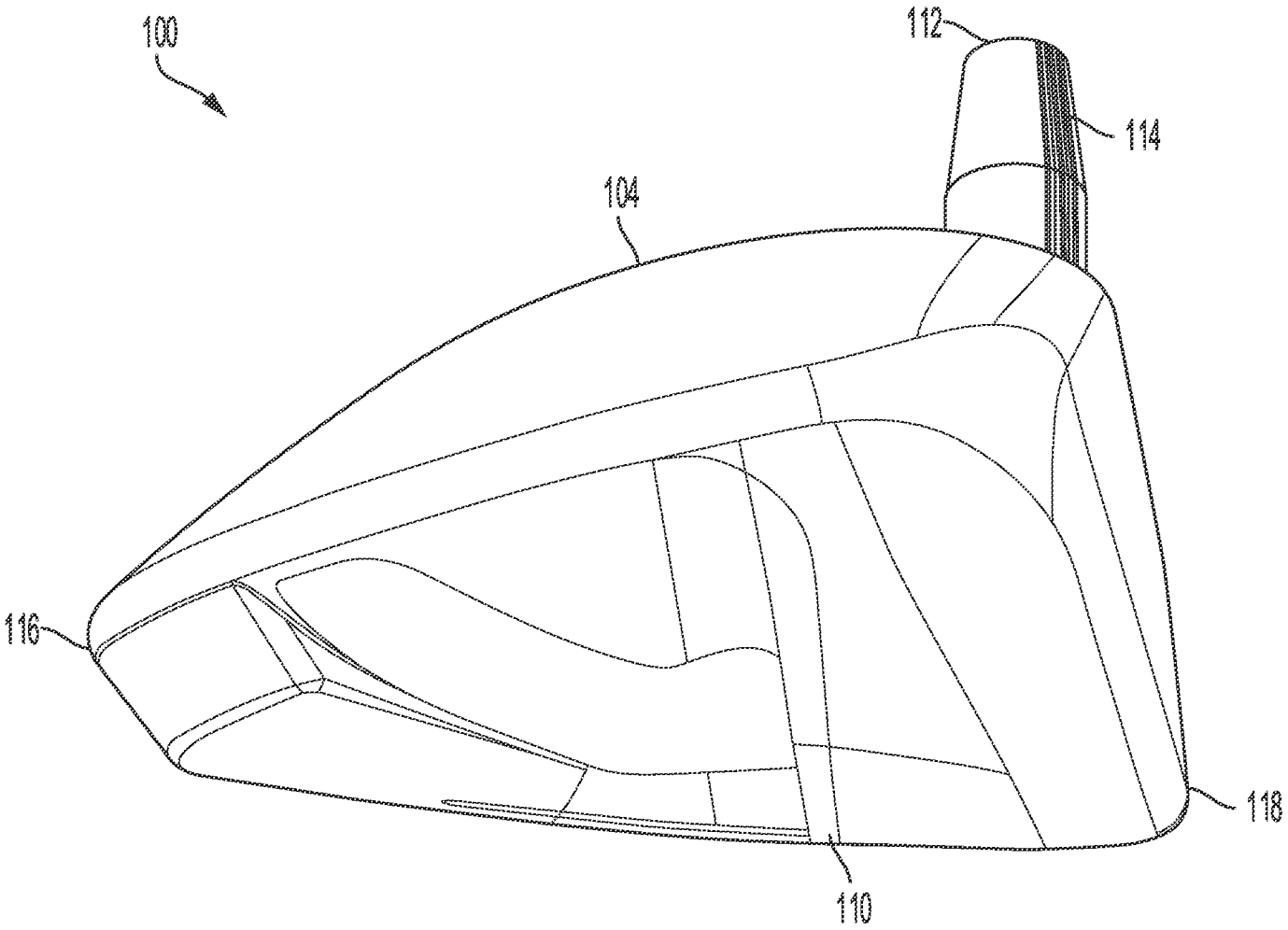
FIG. 4 depicts a toe-side view of the golf club head of FIG. 1.
Figure 5:
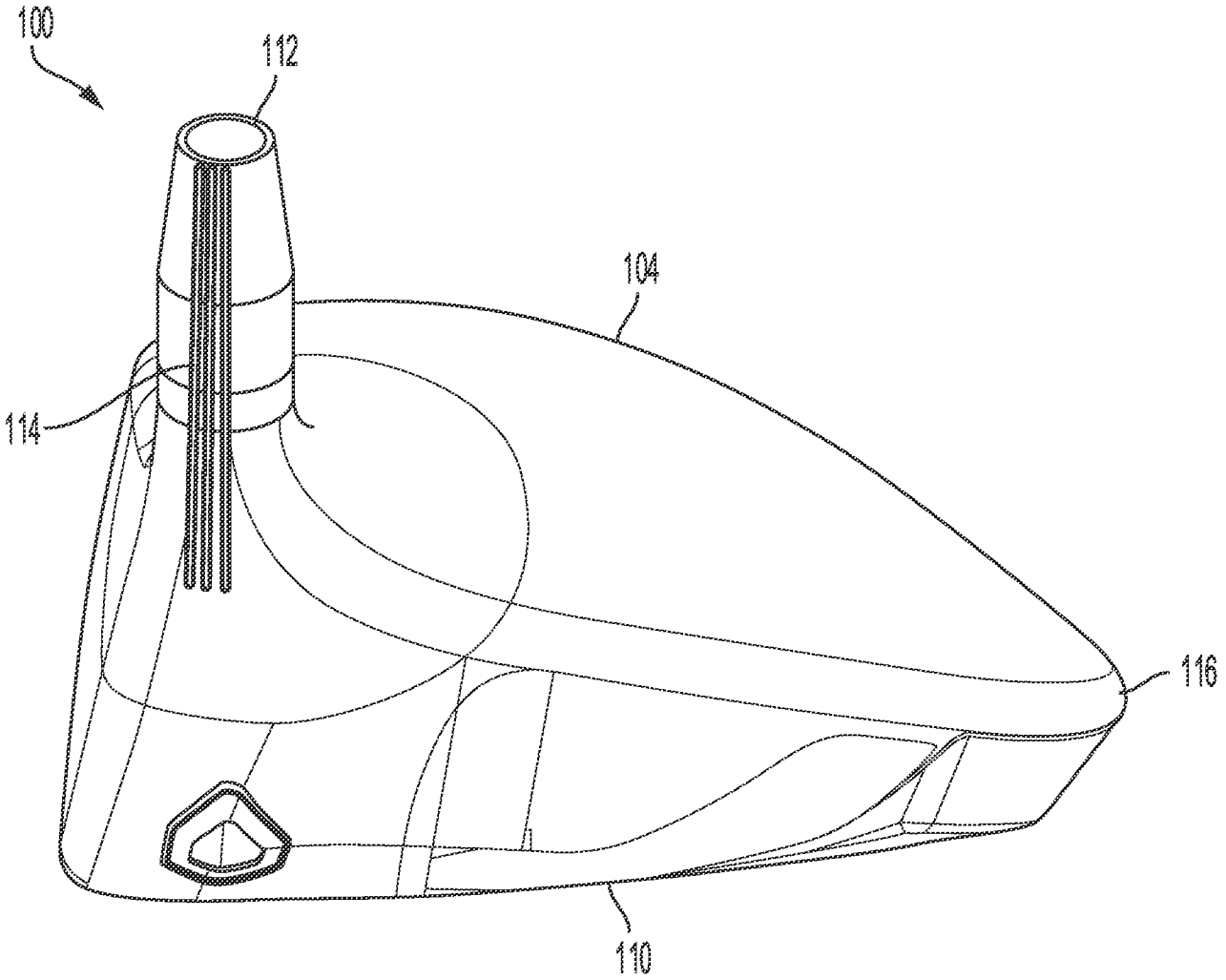
FIG. 5 depicts a heel-side view of the golf club head of FIG. 1.

FIGS. 3A-3B depict top views of the hosel of the golf club head of FIG. 1. FIG. 4 depicts a toe-side view of the golf club head of FIG. 1, and FIG. 5 depicts a heel-side view of the golf club head of FIG. 1. As can be seen from FIGS. 4-5, the golf club head 100 includes a rearmost point 116 (e.g., a trailing edge) and a frontmost point 118 (e.g., a leading edge). FIGS. 3A-3B, 4, and 5 are discussed concurrently.

FIG. 3A depicts a view down the shaft axis (e.g., an axis formed by a shaft that would be connected to the hosel) of the golf club head 100 and indicates the angular positions of the tripping structures with respect to the shaft axis. In FIG. 3A, the three toeward tripping structures 114 are individually labeled as a first toeward tripping structure 114A, a second toeward tripping structure 114B, and a third toeward tripping structure 114C. The three heelward tripping structures are also individually labeled as a first heelward tripping structure 114D, a second heelward tripping structure 114E, and a third heelward tripping structure 114F.

The locations or positions of the tripping structures 114 account for the rotational movement of the club head during a swing of a golf club head. For instance, during the downswing of golf club, the heelward tripping structures 114D-F are more exposed to the airflow, whereas at impact and during the follow through, the toeward tripping structures 114A-C are more exposed to the airflow. Due to the toeward tripping structures 114A-C being located more towards the striking face 102, the toeward tripping structures 114A-C also provide tripping effects during the downswing of the golf club head 100.

The location or position of each of the tripping structures 114 may be described as an angular position around the shaft axis. The angular positions may be described as relative to a toe-to-heel axis 120 or a front-to-back axis 122. The front-to-back axis 122 is an axis that runs from the front of the golf club head 100 to the back of the golf club head, and the toe-to-heel axis 120 is an axis that runs from the toe to heel of the golf club head 100 and is substantially perpendicular to the front-to-back axis 122. For instance, the front-to-back axis 122 may be perpendicular to a plane defined by the striking face 102. In the examples used herein, the front-to-back axis 122 has a zero-degree position pointing forward of the golf club head 100. For instance, the zero-degree shaft-axis angular position may correspond to a direction forward of the golf club head 100 and perpendicular to the plane defined by the striking face 102. The origin of the front-to-back axis 122 and the toe-to-heel axis 120 may be located at the center of the hosel (e.g., at the shaft axis).

The tripping structures 114 on the toeward side of the front-to-back axis 122 are referred to as the toeward tripping structures 114, and the tripping structures 114 that are on the heelward side of the front-to-back axis 122 are referred to as the heelward tripping structures 114. As measured from the front-to-back axis 122, the first toeward tripping structure 114A is located 30 degrees around the shaft axis, as represented by angle $\alpha 1$, as measured in a clockwise direction. The second toeward tripping structure 114B is offset by 15 degrees around the shaft axis from the first toeward tripping structure 114A. The third toeward tripping structure 114C is offset by 15 degrees from the third toeward tripping structure 114C. In other words, the second toeward tripping structure 114B is located 45 degrees around the shaft axis, as represented by angle $\alpha 2$, and the third toeward tripping structure 114C is located 60 degrees around the shaft axis, as represented by angle $\alpha 3$.

Of note, the toeward tripping structures 114A-C are located towards the front of the golf club head 100 from the toe-to-heel axis 120. In other words, the toeward tripping structures are located between 0-90 degrees around the shaft axis as measured from the front-to-back axis 122. By positioning the toeward tripping structures 114A-C towards the front of the golf club head 100, the toeward tripping structures 114A-C are able to provide the tripping effect for more of the downswing of the golf club as the golf club rotates from an open position to a closed position.

As also measured from the front-to-back axis 122, the first heelward tripping structure 114D is located −60 degrees around the shaft axis, as represented by the angle $\beta 1$. The second heelward tripping structure 114E is offset by 15 degrees around the shaft axis from the first heelward tripping structure 114D. The third heelward tripping structure 114F is offset by 15 degrees around the shaft axis from the second heelward tripping structure 114E. In other words, the second heelward tripping structure 114E is located −75 degrees around the shaft axis, as represented by angle $\beta 2$, and the third heelward tripping structure 114F is located −90 degrees around the shaft axis, as represented by angle $\beta 3$. In some examples, the heelward tripping structures may be more easily measured from the toe-to-heel axis 120. For instance, the third heelward tripping structure 114F is aligned with, or parallel to, the heel-to-toe axis 120.

The first toeward tripping structure 114A may be referred to as the frontmost toeward tripping structure 114A, and the first heelward tripping structure 114A may be referred to as the frontmost heelward tripping structure 114D. The frontmost toeward tripping structure 114A and the frontmost heelward tripping structure 114D in the example depicted are positioned 90 degrees apart from one another.

The angular positions of the tripping structures 114 described above are for a particular example, and some variations on the angular positions may also be implemented to achieve the tripping effects described herein. For example, the toeward tripping structures 114 may be located within 0-80 degrees, 10-80 degrees, 10-70 degrees, and/or 30-70 degrees around the shaft axis as measured from the front-to-back axis 122. The heelward tripping structures 114 may be located between −30 to −90, −50 to −90, −60 to −90, and/or −40 to −110 degrees around the shaft axis as measured from the front-to-back axis 122.

The toeward tripping structures 114 and/or the heelward tripping structures 114 may be spaced from one another by an angular amount of 5-25 degrees and/or 10-20 degrees. In some examples, such as the one depicted in FIG. 3A, the toeward tripping structures 114A-C and/or the heelward tripping structures 114D-F may be evenly spaced from one another.

One or more of the toeward tripping structures 114A-C may be symmetrically positioned about radial line of 350 degree (i.e., −10 degree) shaft-axis angle from one or more of the heelward tripping structures 114D-F. For instance, a position of the toeward tripping structure and a position of the heelward tripping structure may be substantially symmetric about a line extending along a 350 degree shaft-axis angle. Such symmetry may improve the overall aerodynamic properties of the hosel 112. As an example, a toeward tripping structure being positioned at a shaft-axis angular position of 0-80 degrees measured around the shaft axis, and a heelward tripping structure may be positioned, symmetrically about the 350 degree line, at a shaft-axis angular position of 260-340 degrees measured around the shaft axis. the toeward tripping structure is located at a shaft-axis angular position of 30-60 degrees and the heelward tripping structure is located at a shaft-axis angular position of 280-310 degrees.

The heights, lengths, and locations of the tripping structures 114 discussed herein are able to trigger a transition from a laminar flow to a turbulent flow around the hosel at the Reynolds numbers and swing speeds typically associated with the swinging of a golf club head. For instance, the tripping structures 114 may be configured to cause tripping from laminar flow to turbulent flow around the hosel at a Reynolds number characteristic of flow conditions experienced by golfers (such as less than 30,000), as the hosel 112 of the golf club head 100 usually is within a 20,000 to 50,000 Reynolds number regime. In addition, the dimensions and locations of the tripping structures 114 are important for causing the transition from the laminar flow to turbulent flow in the proper location. For example, if the tripping occurs too early, the flows will fully separate and not reattach, or if there is a very strong favorable gradient, the flows will relaminarize and then separate—both of which may actually increase drag. The present dimensions and locations of the tripping structures 114 prevent such adverse phenomenon even when the golf club head rotates during a golf swing.

While the tripping structures 114 shown in FIGS. 1-5 are ridges that protrude outwardly from the hosel, in other examples, the tripping structures 114 may take different forms. For instance, the tripping structures 114 may be formed as grooves rather than ridges. The depth of the grooves may be the same as the height of the ridges discussed herein. The grooves may also have similar lengths and positions as the ridges. In some examples, grooves and ridges may be utilized, and the height may be considered an amplitude measured from the peak of the ridge to the valley of the groove.

The tripping structures 114 may also be formed from tooling marks, that have adequate roughness to transition the boundary layer, positioned in similar locations and orientations as the ridges discussed above. Additional patterns, such as three-dimensional sine waves that are roughly axisymmetric with respect to the shaft or hosel axis, may also be used. The sine waves may also be a function of both position along the shaft or hosel axis and the circumferential position around the hosel. A three-dimensional pattern of interconnect ridges, such as a hexagonal pattern, may also be used as tripping structures 114. Dimples or pimples (e.g., the opposite of dimples) may also be used as tripping structures 114 in some examples.

Figure 6:
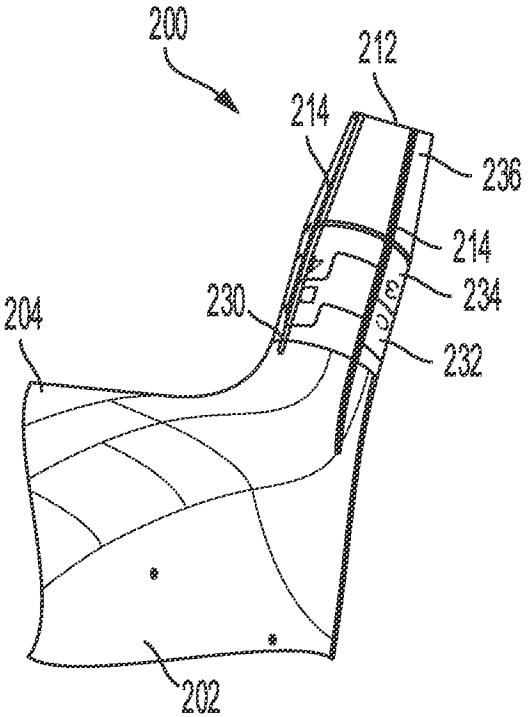
FIG. 6 depicts an adjustable hosel including tripping structures.

FIG. 6 depicts a partial perspective view of a golf club head 200 with an adjustable hosel 212 including tripping structures 214. As with the other examples described above, the golf club head 200 has a striking face 202 and a hosel 212 extends from the crown 204. The adjustable or configurable hosel 212 may be a part of a shaft connection system, and/or the configurable hosel 212 may be adjusted to change characteristics of the golf club head 200, such as the loft and/or lie characteristics of the golf club head 200.

The example configurable hosel 212 depicted in FIG. 6 is similar to the SUREFIT® hosel system from the Acushnet Company of Fairhaven, Massachusetts. The configurable hosel 212 includes a fixed portion 230 attached to the club head 200 near the crown 204 and two configurable or adjustable components: a rotatable ring 232 and a rotatable sleeve 234. The fixed portion 230, the rotatable ring 232, and the rotatable sleeve 234 each include a series of tangs and notches. When the configurable hosel 212 is tightened together, the tangs fit into the notches. By rotating the ring 232 and the sleeve 234, multiple different configuration states for the configurable hosel 212 may be achieved. In the example depicted, the ring 232 includes four different settings as indicated by letter markings A-D, with each setting including a different tang on the ring 232. The sleeve 234 similarly has four different settings as indicated by number markings 1-4, with each setting including a different tang on the sleeve 234. The configuration state of the configurable hosel 212 corresponds to the settings of the ring 232 and the sleeve 234 that are aligned with an alignment reference indicator on the fixed portion 230. A ferrule 236 may also be included. Additional details regarding a similar configurable hosel system may be found in U.S. Pat. No. 9,403,067, titled "Interchangeable Shaft System," which is incorporated herein by reference in its entirety.

The configurable hosel 212 also includes tripping structures 214. The tripping structures 214 may be divided into separate pieces or portions corresponding to the number of different components in the configurable hosel 212. In the example depicted, there are four components of the adjustable hosel 212—the fixed portion 230, the rotatable ring 232, the rotatable sleeve 234, and the ferrule 236. The tripping structures 214 extend across each of the four components. To allow for adjustment of the adjustable hosel 212, each of the tripping structures are separated into four pieces corresponding to the four different components of the adjustable hosel 212. For instance, each tripping structure 214 may have a first piece on the ferrule 236, a second piece on the sleeve 234, a third piece on the ring 232, and a fourth piece on the fixed portion 230. Each of the pieces of the tripping structure 214 may be separated from one another, such as by a cut, or the pieces of the tripping structures 214 may be separately formed as part of the respective components, such as the ring 232 and the sleeve 234. Accordingly, as the adjustable components of the hosel 212 (e.g., the ring 232 and the sleeve 234) are rotated, the corresponding piece of the tripping structure 214 move with the respective adjustable component. For example, the pieces of tripping structures 214 located on the ring 232 move with the ring 232 as the ring 232 is rotated.

The number and/or positions of the tripping structures 214 may be based on the number of different settings available from the adjustable components of the hosel 212. In the example depicted, the ring 232 and the sleeve 234 each have four possible settings (e.g., settings A-D and settings 1-4). Accordingly, four tripping structures 214 may be incorporated into the hosel 212. Each of the four setting positions on the ring 232 and the sleeve 234 are offset by 90 degrees (e.g., 360 degrees divided by four). Thus, the four tripping structures 214 are also offset from one another by 90 degrees. As a result, in any setting combination of the ring 232 and the sleeve 234, the respective pieces of the tripping structures 214 align with other pieces of the tripping structures 214 to form the full-length tripping structures 214. With the offsets of 90 degrees, the tripping structures 214 may be located in the angular positions discussed above with respect to FIGS. 1-5. The pieces of the tripping structures 214 on the adjustable components of the hosel 212 may also be made such that all the pieces have the same size and shape (e.g., same thickness, length, width, cross-section, etc.), which further allows for consistent forming of the full tripping structures 214 in any of the settings of the adjustable components.

As another example, if the adjustable components have only three settings, three tripping structures 214 may be included and may be offset by 120 degrees, whereas if the adjustable components have five settings, five tripping structures 214 may be incorporated and may be offset by 72 degrees. The number of tripping structures 214 may be equal to the number of settings, and the offset angle of the tripping structures 214 may be based on the offset angles of the different settings of the adjustable components. In some examples, multiple tripping structures 214 may be included on each of the different settings (such as the tangs of the ring 232). In such examples, the number of tripping structures 214 may be equal to a multiple of the number of settings. For instance, for an adjustable component with four settings, 4, 8, 12, or 16 tripping structures 214 may be included on the hosel 212.

Figure 7:
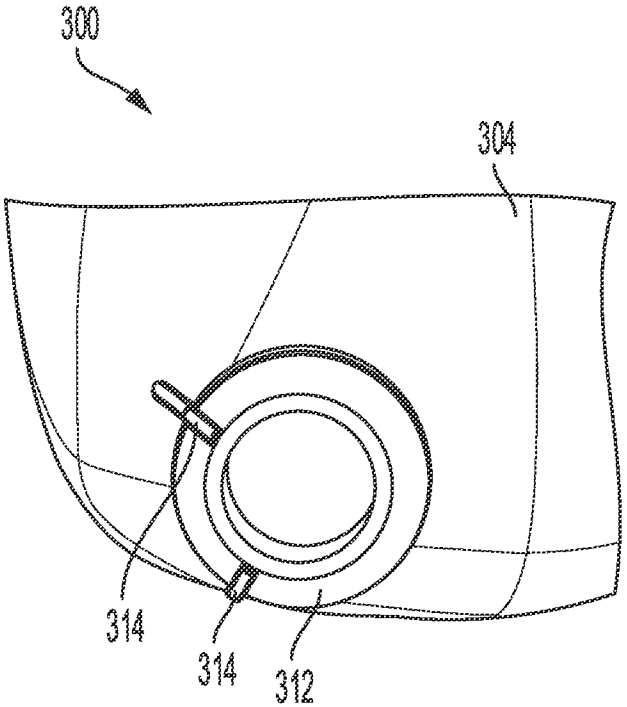
FIG. 7 depicts a top view a hosel with tripping structures.

FIG. 7 depicts a partial top view golf club head 300 with a hosel 312 with tripping structures 314. As with the other examples described above, the hosel 312 extends from the crown 304. In this example, however, only two tripping structures 314 are included on the hosel. The two tripping structures 314 are offset from one another by about 90 degrees. Both of the tripping structures 314 are incorporated on the front half of the hosel 312 as well. For instance, both tripping structures 314 are located on the striking-face side of the hosel 312 rather than rear side of the hosel 312. As discussed above, by incorporating the tripping structures 314 on the front side of the hosel, the tripping structures 314 cause the tripping effects at more points during a golf swing due to the rotation of the golf club head.

Figure 8:
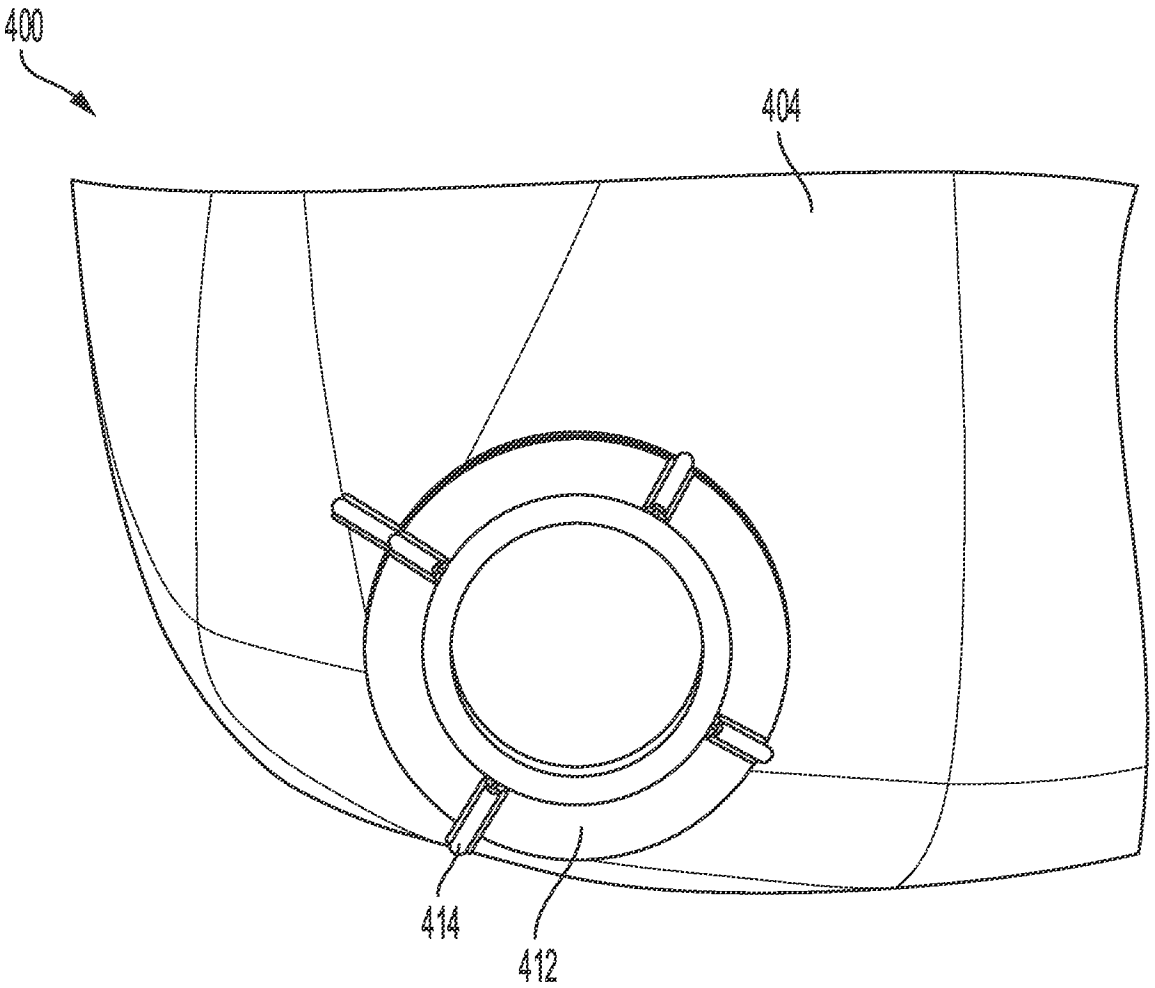
FIG. 8 depicts a top view of another hosel with tripping structures.

FIG. 8 depicts another partial top view golf club head 400 with a hosel 412 with tripping structures 414. As with the other examples described above, the hosel 412 extends from the crown 404. In this example, four tripping structures 414 are incorporated on the hosel 412. The four tripping structures 414 are offset from one another by 90 degrees. Two of the tripping structures 414 are included on the front half of the hosel 412, and two of the tripping structures 414 are included on the rear half of the hosel 412. The four tripping structures 414 and their locations may be suitable for a golf club head including an adjustable hosel components with four settings, such as the golf club head 200 discussed above with reference to FIG. 6.

Testing of prototype golf club heads have also demonstrated improvements due to the incorporation of the above tripping structures. For example, testing was performed using a control club (e.g., a club with no hosel tripping structures) and a test golf club head with tripping structures added to the hosel of the control club. Testing was performed by applying the same force to the golf clubs via a robotic swinging system in substantially the same aerodynamic conditions (e.g., location, air temperature, etc.) The results of the testing indicated that the control club had an average swing speed of 105.21-105.59 miles per hour (mph), and the testing club had an average swing speed of up to 106.07 mph. Thus, with the same force applied, a swing speed increase of up to 0.48-0.86 mph was observed based on the inclusion of the hosel tripping structures. For the testing, the tripping structures of the test club had a configuration similar to the configuration shown in FIGS. 1-5 and the tripping structures had heights of 0.012 inches. Additional testing using tripping structure configurations such as those in FIGS. 6-8 also indicated increases in swing speeds.

Figure 9:
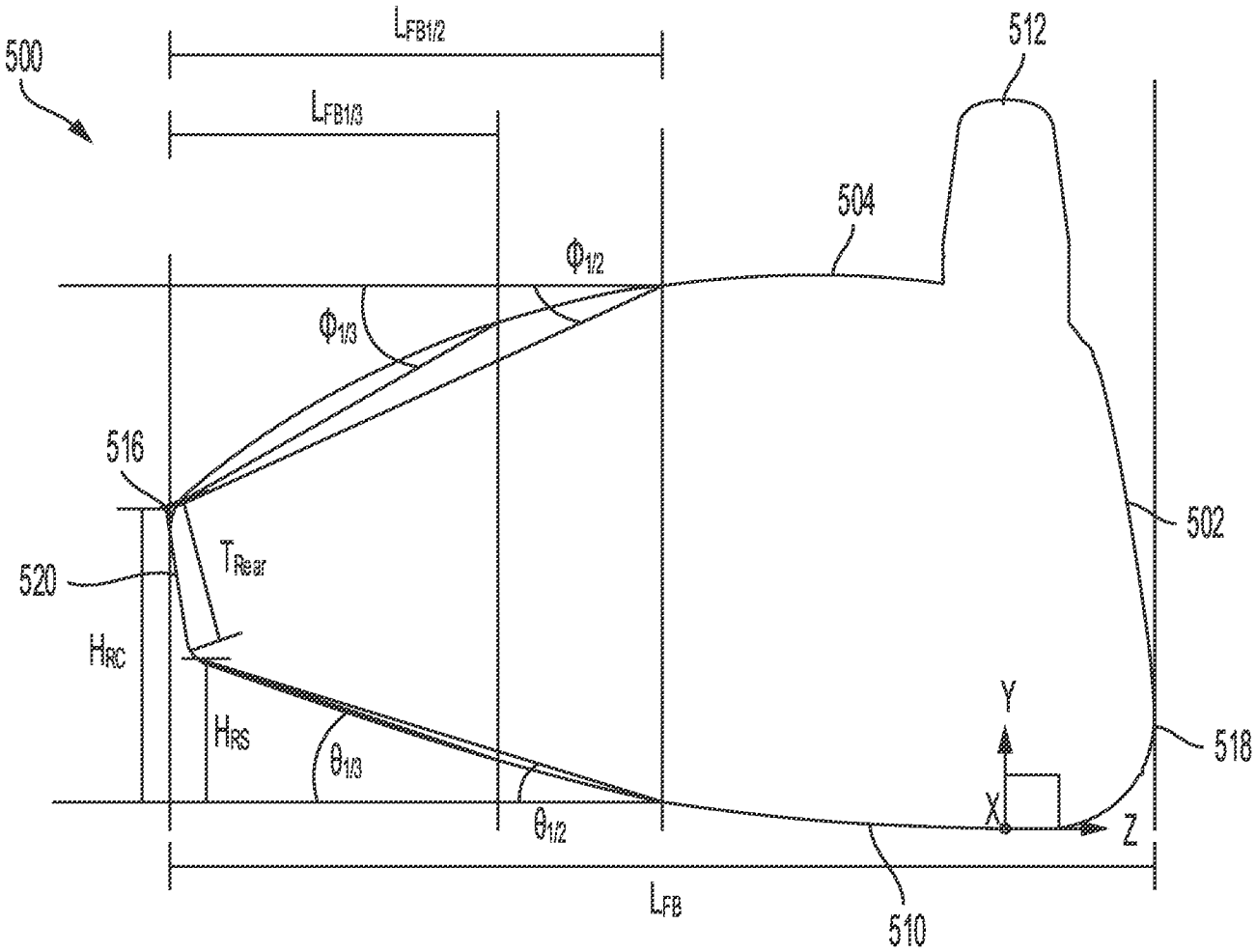
FIG. 9 depicts an example golf club head with improved drag properties.

FIG. 9 depicts an example golf club head 500 with improved drag properties. The representation of the golf club head 500 shown in FIG. 9 is a projected silhouette of the golf club from a toe-side viewpoint. The golf club head 500 shown here is setup at an address position that replicates how the golf club head 500 will interact with a golf ball. The address position, as defined by the current invention, sets up the golf club head 500 at an orientation that has a lie angle of 60 degrees similar to the requirements of the United States Golf Association (USGA). Once the lie angle is set at 60 degrees, the face angle of the golf club head 500 is set to be square, which is defined as having a face angle of 0 degrees.

Like the golf club heads described above, the golf club head 500 includes a striking face 502, a crown 504, a sole 510, and a hosel 512. The golf club head 500 also has a frontmost point 518 and a rearmost point 516. The frontmost point 518 may also be referred to as a leading edge, and the club head rearmost point 516 may also be referred to as the trailing edge.

The golf club head 500 also includes a skirt 520 or "boat tail" portion that connects the crown 504 and the sole 510. The skirt 520 may be defined as a portion of the club head 500 that is between the crown 504 and the sole 510, and defines a plane having an angle that is substantially different from the planes formed by either the crown 504 or the sole. For instance, the skirt 520 may define a plane that is within 80-120 percent of a loft angle of the golf club head 500. The angle of the plane formed by the skirt 520 may be referred to as the skirt angle. In other examples, the skirt 520 defines a plane that is within 20 degrees of being perpendicular to a ground plane defined by the ground.

The dimensions of the golf club head 500 result in the golf club head 500 experiencing lower drag during a swing of the golf club head 500. The dimensions of the golf club head 500 include a front-to-back length ($L_{FB}$), a ½ front-to-back length ($L_{FB1/2}$), and a ⅓ front-to-back length ($L_{FB1/3}$). The front-to-back length ($L_{FB}$) is the length between the club head frontmost point 518 and the club head rearmost point 516 as measured along the ground plane. The front-to-back length ($L_{FB}$) may also be referred to as the head length. The golf club head 500 also has a club head height that is measured from the lowest point on the sole to the highest point on the crown in a direction perpendicular to the ground plane.

Closing descent angles ($\Phi$) and closing ascent angles ($\theta$) are also defined by the golf club head 500. The closing descent angles ($\Phi$) indicate how steeply the crown 504 is closing towards the rear of the golf club head 500. The closing ascent angles ($\theta$) indicate how steeply the sole 510 is closing towards the rear of the golf club head 500.

The closing descent angle (Φ) is defined as an angle between (1) a line from a point on the crown 504, of the projected silhouette of the golf club from the toe-side viewpoint, to the rearmost point 516 of the crown 504 and (2) a plane intersecting the crown point and parallel to the ground plane. The rearmost point 516 of the crown 504 may be an intersection point of the crown 504 and an upper boundary of the skirt 520. The closing descent angles (Φ) may be measured from different points on the golf club head 500. For instance, a half-point closing descent angle ($\Phi_{1/2}$) may be measured from a point on the crown 504 that is halfway between the frontmost point 518 and the rearmost point 516 of the club head 500 (e.g., from a point located the ½ front-to-back length ($L_{FB1/2}$) from the rearmost point 516 as measured along the ground plane.) A third-point closing descent angle ($\Phi_{1/3}$) may be measured from a point on the crown 504 that is located the ⅓ front-to-back length ($L_{FB1/3}$) from the rearmost point 516 of the golf club as measured along the ground plane. In the example depicted, the rearmost point 516 of the golf club happens to also be the rearmost point 516 of the crown 504.

The closing ascent angle (θ) is defined as an angle between (1) a line from a point on the sole 510, of the projected silhouette of the golf club from the toe-side viewpoint, to the rearmost point 517 of the sole 510 and (2) a plane intersecting the sole point and parallel to the ground plane. The rearmost point 517 of the sole 510 may be an intersection point of the sole 510 and a lower boundary of the skirt 520. The closing ascent angles (θ) may be measured from different points on the golf club head 500. For instance, a half-point closing ascent angle ($\theta_{1/2}$) may be measured from a point on the sole 510 that is halfway between the frontmost point 518 and the rearmost point 516 of the club head 500 (e.g., from a point located the ½ front-to-back length ($L_{FB1/2}$) from the rearmost point 516 as measured along the ground plane.) A third-point closing ascent angle ($\theta_{1/3}$) may be measured from a point on the sole 510 that is located the ⅓ front-to-back length ($L_{FB1/3}$) from the rearmost point 516 of the golf club as measured along the ground plane.

The height and thickness of the skirt 520 also have an impact on the aerodynamics of the golf club head. The height of the skirt may be represented by the height ($H_{RS}$) of the rearmost point of the sole 510 above or off the ground plane. The rearmost point of the sole 510 represents the lowest point of the skirt 520. The height of the skirt 520 may also be represented by the height ($H_{RC}$) of the rearmost point 516 of the crown 504 off the ground plane. The thickness ($T_{Rear}$) of the rear portion the skirt 520 shown in the projection may then be defined by the distance between the rearmost point 516 of the crown 504 and the rearmost point 517 of the sole 510. For instance, the thickness ($T_{Rear}$) may be the shortest distance between the rearmost point 516 of the crown 504 and the rearmost point 517 of the sole 510 as measured in the projection.

As discussed above, configuring these dimensions of the golf club head 500 allows for improvements to the aerodynamic properties by reducing the pressure drag forces experienced by the golf club head 500 during a swing. For instance, by raising the aft portion of the skirt 520 or boat tail and/or increasing the thickness of the aft portion of the skirt 520, the closure angles of the crown 504 and the sole may be reduced and controlled. By reducing the closure angles, the separation of the turbulent flow of air over the crown 504 and/or sole 510 may be moved further rearward on the golf club head 500. Delaying the turbulent flow separation (e.g., moving the turbulent flow separation more rearward) results in a lower pressure drag forces acting on the golf club head 500 during the golf club swing. Additional reductions to pressure drag forces may be achieved by bringing the closing ascent angle (θ) closer to the closing descent angles (Φ).

As some examples, the height ($H_{RS}$) of the rearmost point of the sole 510 off the ground plane may be between 12 mm and 35 mm. The height ($H_{RC}$) of the rearmost point 516 of the crown 504 off the ground plane may be between 28 and 45 mm. The thickness of the skirt 520 ($T_{Rear}$) may be between 8 and 20 mm. Different combinations of $H_{RS}$ and $T_{Rear}$ may be utilized to achieve the aerodynamic benefits of the present technology. For example, as the skirt 520 is raised higher off the ground, the skirt 520 may not need to be as thick to achieve the shallower closure angles of the crown 504 and the sole 510. The thickness of the skirt 520 may also be adjusted based on the height of the skirt 520 to better match the closing ascent angles (θ) of the sole 510 with the closing descent angles (Φ) of the crown 504. These ranges of heights generally represent a heightened and/or thickened skirt 520 as compared to other drivers, which may have $H_{RS}$ values of about 9 mm, $H_{RC}$ values of about 22 mm, and $T_{Rear}$ values of about 16 mm.

As will also be understood, the closing ascent angles (θ) of the sole 510 and the closing descent angles (Φ) are also dependent on the height of the golf club head 500 as well as the club length or the front-to-back length ($L_{FB}$). The height of the golf club head 500 for a driver may be greater than 2 inches (50.8 mm), but may be lower for other types of metal woods, such as fairway metals. In some examples, the height of the golf club head 500 may be between 2 inches (50.8 mm) and 2.8 inches (71.12 mm). For a driver, the front-to-back length ($L_{FB}$) may be between 4.13 inches (105 mm) to 4.72 inches (120 mm) or between 4 inches (101.6 mm) to 5 inches (127 mm). In some examples, the front-to-back length ($L_{FB}$) may be less than 4.5 inches (114.3 mm).

Because some of the above dimensions may change as the type of metal wood changes (e.g., from drivers to fairway metals or other types of metal woods), the above dimensions may be better represented as ratios that help maintain the types closure angles of the crown 504 and the sole 510 that provide the improved aerodynamic properties discussed herein. For example, a ratio between (1) the front-to-back length ($L_{FB}$) (e.g., the head length) and (2) the height ($H_{RS}$) of the rearmost point of the sole 510 off the ground plane (e.g., the skirt height) may be utilized. This ratio may be referred to as the head-length-to-skirt-height ratio. The head-length-to-skirt-height ratio may be between 3:1 and 8.5:1, between 3.4:1 and 5.8:1, or less than 6:1. The value of the head-length-to-skirt-height ratio may be based on the skirt thickness ($T_{Rear}$) as well. For instance, for the head-length-to-skirt-height ratio may be greater where the skirt thickness ($T_{Rear}$) is smaller. For instance, for a skirt thickness ($T_{Rear}$) between 10-14 mm, the head-length-to-skirt-height ratio may be between 3.46:1 and 5.7:1. For a skirt thickness ($T_{Rear}$) between 16-18 mm, the head-length-to-skirt-height ratio may be between 4.3:1 and 8.5:1.

A ratio between the head length and skirt thickness ($T_{Rear}$) may also be utilized, and such a ratio may be referred to as a head-length-to-skirt-thickness ratio. The head-length-to-skirt-thickness ratio may be between 6:1 and 11:1, between 6.5:1 and 8.5:1, or less than 9:1. The head-length-to-skirt-thickness ratio may also depend on the skirt height similar to how the head-length-to-skirt-height ratio is dependent on the skirt thickness, as discussed above.

The closing descent angles (Φ) and the closing ascent angles (θ) of sole may be within ranges of degrees and the angles may be based on one another to more closely match the closing descent angles (Φ) to the closing ascent angles (θ). The half-point closing descent angle ($\Phi_{1/2}$) may be between 15 and 30 degrees, less than 30 degrees, or less than 20 degrees. The third-point closing descent angle ($\Phi_{1/3}$) 20 and 35 degrees, less than 35 degrees, less than 30 degrees, or less than 25 degrees. For instance, half-point closing ascent angle ($\theta_{1/2}$) may be between 15 and 30 degrees, less than 30 degrees, or less than 20 degrees. The third-point closing ascent angle ($\theta_{1/3}$) may be between 10-35 degrees, less than 35 degrees, or less than 20 degrees. As the closing descent angles (Φ) and the closing ascent angles (θ) become shallower, the golf club head 500 may incur less pressure drag effects.

In addition, as the closing descent angles (Φ) and the closing ascent angles (θ) become more closely matched, the golf club head 500 may also receive less pressure drag effects. For instance, in some examples the respective closing descent angles (Φ) and the closing ascent angles (θ) may be within 85% to 115% of one another. In another example, the respective closing descent angles (Φ) and the closing ascent angles (θ) may be within 95% to 105% of one another. For example, the half-point closing descent angle ($\Phi_{1/2}$) may be within 85% to 115% or 95% to 105% of the half-point closing ascent angle ($\theta_{1/2}$). Similarly, the third-point closing descent angle ($\Phi_{1/3}$) may be within 85% to 115% or 95% to 105% of the third-point closing ascent angle ($\theta_{1/3}$).

Additionally or alternatively, there may be no tangent line to the aft half of the crown 504 in the projected silhouette that is greater than 45 degrees, 40 degrees, or 30 degrees. Stated another way, all tangent lines that can be drawn on the aft half of the crown 504 in the projected silhouette may have an angle relative to the ground plane that is less than or equal to 45 degrees, 40 degrees, or 30 degrees. Similarly, there may be no tangent line to the aft half of the sole 510 in the projected silhouette that is greater than 45 degrees, 40 degrees, or 30 degrees. Stated another way, all tangent lines that can be drawn on the aft half of the sole 510 in the projected silhouette may have an angle relative to the ground plane that is less than or equal to 45 degrees, 40 degrees, or 30 degrees.

The table provided in FIG. 10 includes a listing of dimensions for ten example golf club heads that have dimensions based on the present technology to alter the closing angles of the sole and crown of the respective golf clubs. As can be seen from the data in the table, many of the example clubs satisfy the above relationships and characteristics.

Figure 11:
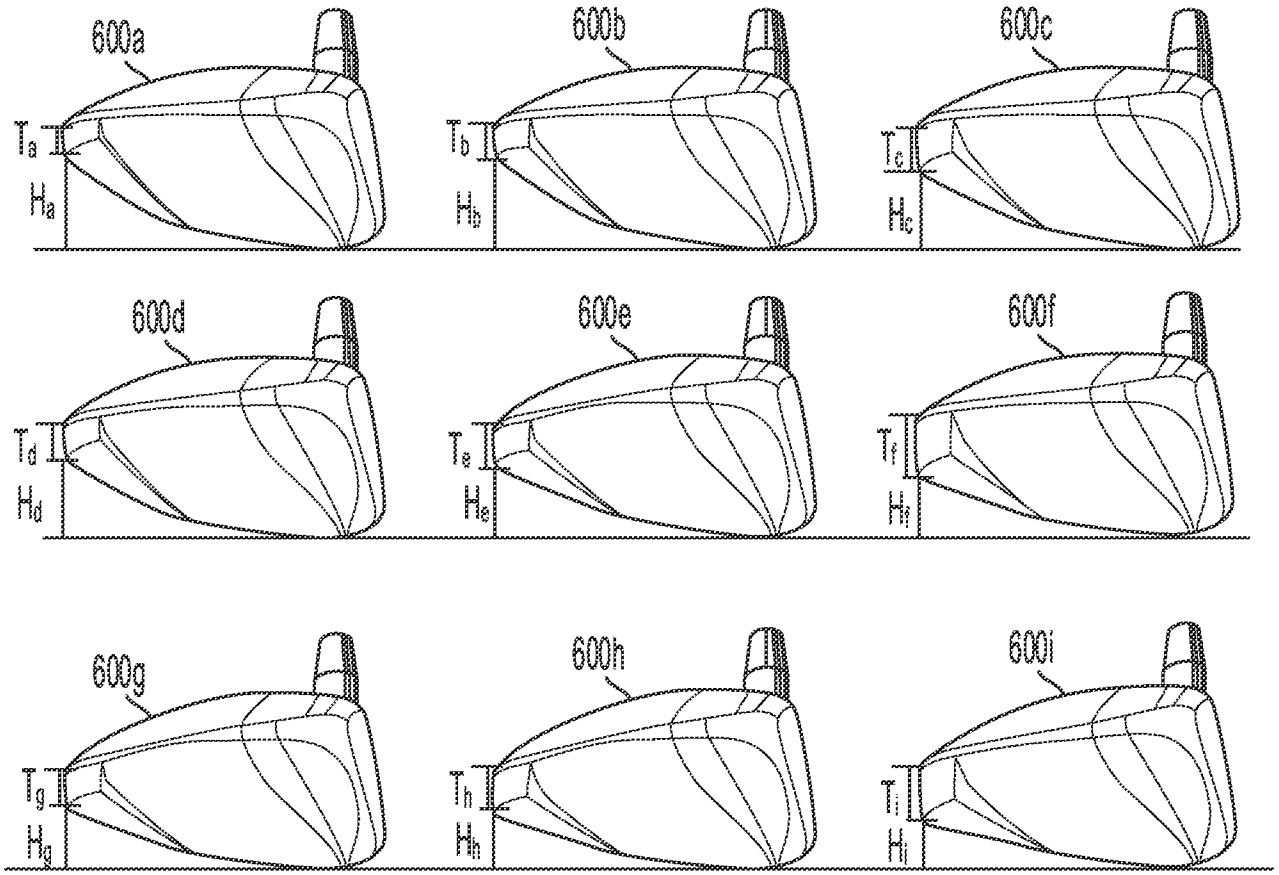
FIG. 11 depicts examples of golf club heads with improved drag properties.

FIG. 11 depicts examples of golf club heads with improved drag properties. The example golf clubs 600*a-i* in FIG. 11 each have different combinations of skirt thickness and skirt heights. In FIG. 11, the skirt thicknesses are labeled with a T and the skirt heights are indicated with an H. The skirt thicknesses (T) in FIG. 11 may be the same or substantially the same dimension as the thickness ($T_{Rear}$) of the rear portion the skirt, discussed above in FIG. 9. The skirt heights (H) may be the same dimension as the height ($H_{RS}$) of the rearmost point of the sole 510 off the ground plane, as discussed above in FIG. 9.

Golf club 600*a* has a skirt thickness of $T_a$ and a skirt height of $H_a$. Golf club 600*b* has a skirt thickness of $T_b$ and a skirt height of $H_b$. Golf club 600*c* has a skirt thickness of $T_c$ and a skirt height of $H_c$. Golf club 600*d* has a skirt thickness of $T_d$ and a skirt height of $H_d$. Golf club 600*e* has a skirt thickness of $T_e$ and a skirt height of $H_e$. Golf club 600*f* has a skirt thickness of $T_f$ and a skirt height of $H_f$. Golf club 600*g* has a skirt thickness of $T_g$ and a skirt height of $H_g$. Golf club 600*h* has a skirt thickness of $T_h$ and a skirt height of $H_h$. Golf club 600*i* has a skirt thickness of $T_i$ and a skirt height of $H_i$.

As can be seen in the first row of golf club heads 600*a-c*, raising the skirt height allows for a shallower closing descent angle of the crown. However, with thinner skirt thicknesses, the closing ascent angle of the sole is quite steep. As the thickness of the skirt become increasingly greater from golf club head 600*a* to golf club head 600*c*, it can be seen that the closing ascent angle of the sole becomes shallower and becomes closer to the closing descent angle of the crown.

Similar results are seen in the second row, which includes example golf club heads 600*d-f*. The skirt heights (T) of the golf club heads 600*d-f* is less than the skirt heights (T) of the golf club heads 600*a-c* in the first row. The lower skirt height (T) in golf club heads 600*d-f* result in a steeper closing descent angle of the crown but also results in a shallower closing ascent angle of the crown—especially as the skirt thickness increases.

In the last row, which includes example golf club heads 600*g-i*, the skirt heights (H) are generally lower than that of the respective golf club heads 600*a-f* in the first and second row. By moving the skirt height even lower, the closing ascent angle of the sole is further reduced, but the closing descent angle begins to increase more dramatically. As the skirt thickness (T) increases, the closing ascent angle of the sole further decreases to point that it is shallower than the closing descent angle of the crown.

Testing of prototype golf club heads have also shown improvements due to the incorporation of the aerodynamic shaping to modify the skirt heights and thicknesses along with the closing angles. For example, testing was performed using a control club (e.g., a club with a more traditional low skirt height) and a test golf club heads with raised skirts. Testing was performed by applying the same force to the golf clubs via a robotic swinging system in substantially the same aerodynamic conditions (e.g., location, air temperature, etc.) In testing, raising the skirt by 0.25 inches resulted in an increase in club head speed of 0.44 mph, and raising the skirt by 0.5 inches resulted in increases in club head speed of between 0.57-0.91 mph. Golf club heads that included both the raised skirt and the tripping structures discussed above resulted in a combined even greater increase in swing speed.

Figure 12:
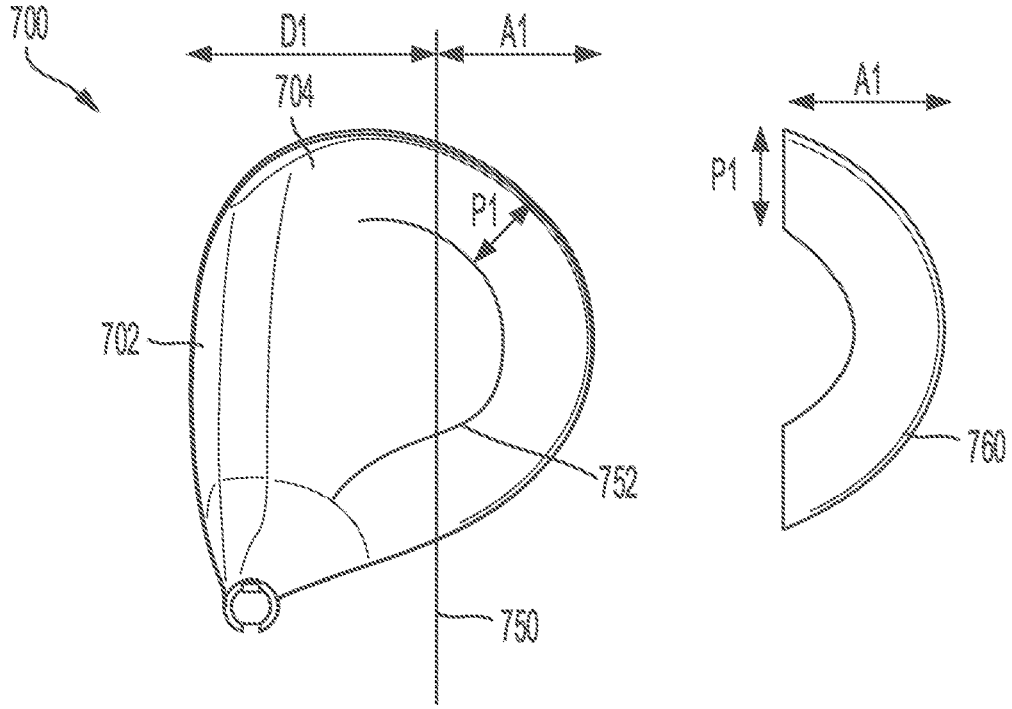
FIG. 12 depicts a top view of an example golf club head and an example aft slice.

FIG. 12 depicts a top view of an example golf club head 700 and an example aft slice 760. The example golf club head 700 may be similar or the same as the golf club heads discussed above. For instance, the golf club head 700 includes a crown 704 and a striking face 702.

Raising the skirt and/or thickening the skirt also generally raises the aft portion of the club head 700 to improve the aerodynamic properties of the golf club. To identify the characteristics of the aft portion of the club head 700, an aft slice 760 of the golf club head 700 may be considered. The aft slice 760 is a portion of the golf club head 700 to the rear of a slice line 750 and between an outer perimeter of the golf club head 700 and an offset perimeter slice curve 752. The slice line 750 runs in the heel-to-toe direction (e.g., parallel with a heel-to-toe axis) and is located a slice depth D from the frontmost point of the golf club head. The offset perimeter slice curve 752 is offset from the outer perimeter of the golf club head 700 by a perimeter offset distance P. The offset perimeter slice curve 752 follows the outline or contour of the outer perimeter at the offset position. For instance, an aft portion of the golf cub head 700 to the rear of the slice line 750 may be identified. A perimeter portion that is offset by the perimeter-offset distance P from the outer perimeter of that aft portion is then extracted or identified to form or define the aft slice 760. The aft slice 760 may be formed or extracted computationally by generating a three-dimensional scan of the golf club head or other computer modelling of the golf club head. In the example depicted in FIG. 12, the slice depth D1 is 60% of the front-to-back length of the club head 700 measured from the frontmost point of the golf club head, and the perimeter offset distance P1 is 1.0 inches.

The aft slice 760 also has an aft depth A that is measured from rearmost point of the aft slice 760 to the frontmost point of the aft slice 760 (e.g., slice line 750). The aft depth A of the aft slice 760 is equal to the difference of the front-to-back length of the club head 700 and the slice depth D. In the example depicted in FIG. 12, the aft depth A1 of the aft slice 760 is equal to 40% of the front-to-back length of the club head 700.

Figure 13:
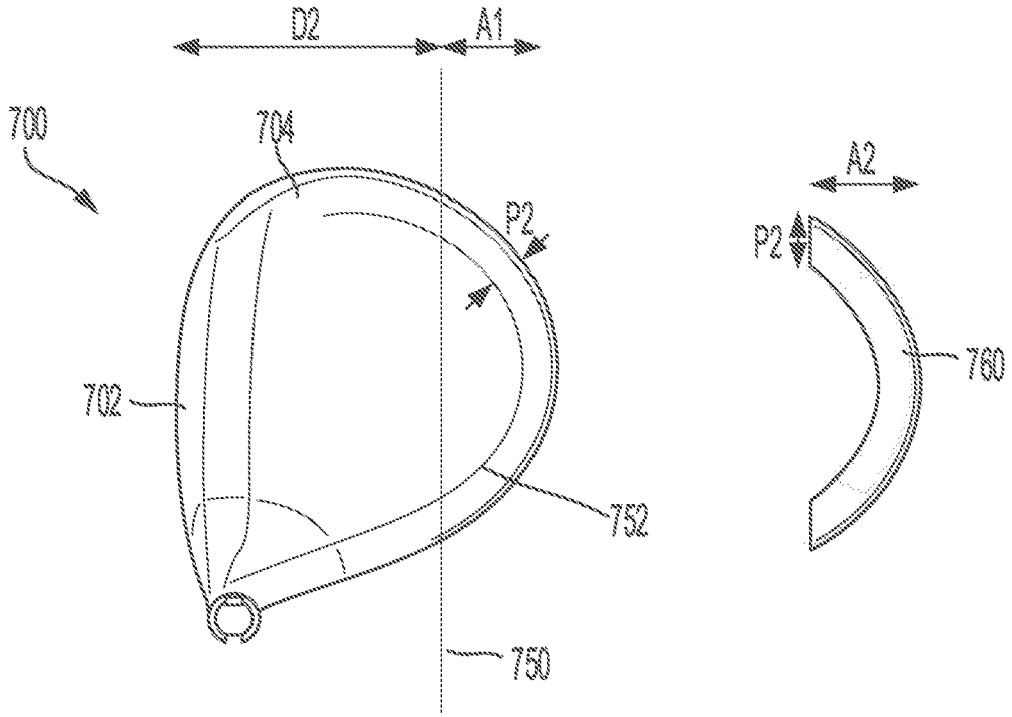
FIG. 13 depicts a top view of an example golf club head and another example aft slice.

FIG. 13 depicts a top view of an example golf club head 700 and another example aft slice 760. The aft slice in FIG. 13 differs from the aft slice 760 in FIG. 12 in that the slice depth D2 is greater than the slice depth D1, and the perimeter-offset distance P2 is less than the perimeter-offset distance P1. Because the slice depth D2 is greater than the slice depth D1, the aft depth A2 is less than the aft depth A1. In the example depicted in FIG. 13, the slice depth D2 is 70% of the front-to-back length of the golf club head 700, the aft depth A2 is 30% of the front-to-back length of the golf club head 700, and perimeter-offset distance P2 is 0.5 inches.

Figure 14:
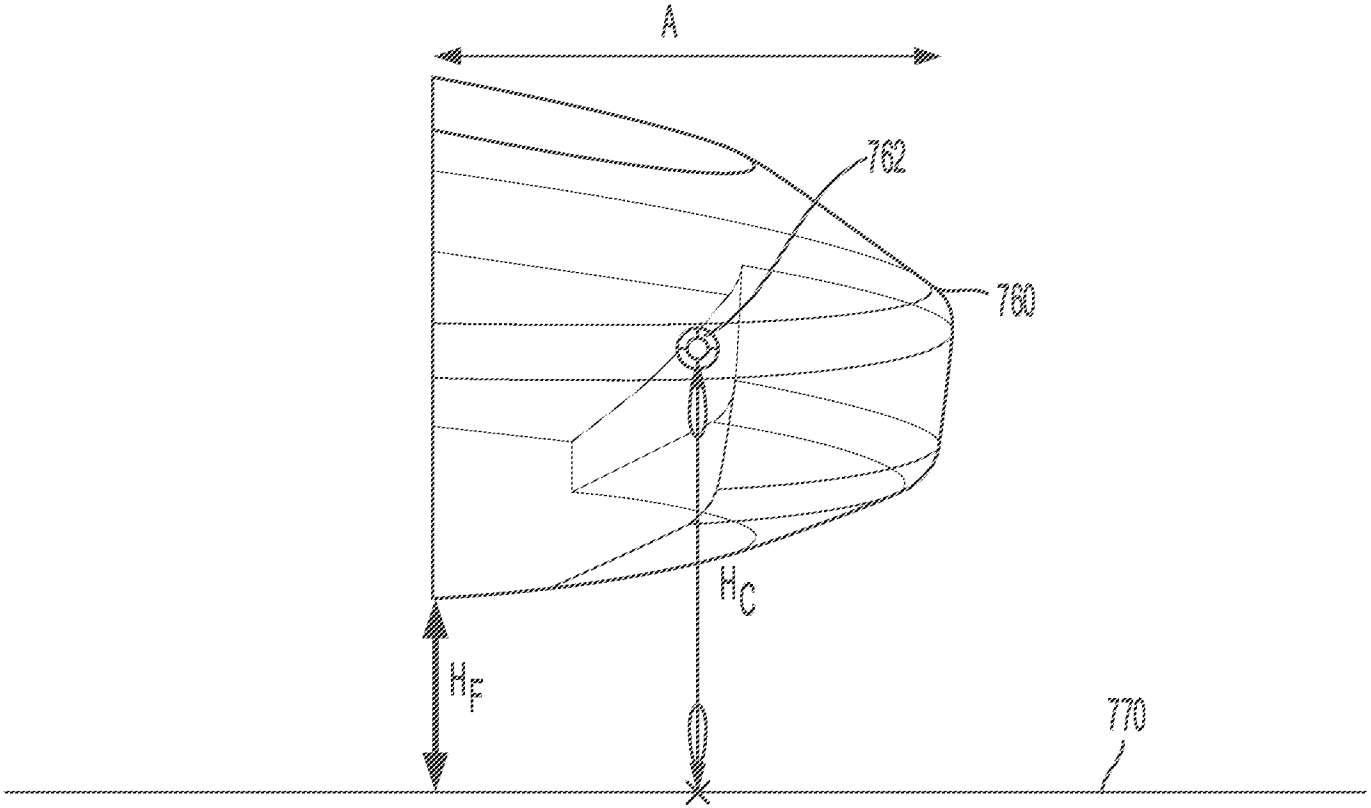
FIG. 14 depicts a side view of an example aft slice.

FIG. 14 depicts a side view of an example aft slice 760. More specifically, FIG. 14 depicts a projected silhouette of the aft slice 760 from a side view, which may be from a toe-side viewpoint or a heel-side viewpoint. The projected silhouette is generated with the golf club head 700 (from which the aft slice 760 is generated) setup at an address position that replicates how the golf club head 700 will interact with a golf ball. The address position, as defined by the current invention, sets up the golf club head 700 at an orientation that has a lie angle of 60 degrees similar to the requirements of the USGA. Once the lie angle is set at 60 degrees, the face angle of the golf club head 700 is set to be square, which is defined as having a face angle of 0 degrees.

Two dimensions of the aft slice 760 may be acquired or determined from the projected side-view silhouette of the aft slice 760. The first dimension is a height ($H_{Centroid}$) of a centroid 762 of the aft portion 760 above a ground plane 770. A centroid of an object may be considered the center of gravity of the solid object assuming uniform density. To calculate the centroid 762 of the aft slice 760, all internal geometry of the aft slice 760 may be filled in (mathematically, computationally, etc.) to be a solid object and assumed to have the same density throughout. The center of gravity of that solid object may then be determined or calculated as the centroid 762. The second dimension is a height ($H_{Low}$) of the lowest point of the aft slice 760, in the silhouette, above the ground plane 770.

In examples where the slice depth D is 60% of the front-to-back length of the golf club head 700, the aft depth A is 40% of the front-to-back length of the golf club head 700, and perimeter-offset distance P is 1.0 inches, the height ($H_{Low}$) of the lowest point of the aft slice 760 may be between 5-10 mm, and the centroid height ($H_{Centroid}$) may be between 28-35 mm. For example, the height ($H_{Low}$) of the lowest point of the aft slice 760 may be greater than 6 mm, and the centroid height ($H_{Centroid}$) may be greater than 29 mm.

In examples where the slice depth D is 70% of the front-to-back length of the golf club head 700, the aft depth A is 30% of the front-to-back length of the golf club head 700, and perimeter-offset distance P is 0.5 inches, the height ($H_{Low}$) of the lowest point of the aft slice 760 may be between 10-15 mm, and the centroid height ($H_{Centroid}$) may be between 28-35 mm. For example, the height ($H_{Low}$) of the lowest point of the aft slice 760 may be greater than 10, 11, or 12 mm, and the centroid height ($H_{Centroid}$) may be greater than 28 mm. In some examples, the centroid height ($H_{Centroid}$) may be at least 50% of the club head height of the golf club head 700. In some examples, the centroid height ($H_{Centroid}$) that is at least 95% of a height of a geometric center of the striking face 702 above a ground plane. For instance, the centroid height ($H_{Centroid}$) may also be greater than or equal to a height of a geometric center of the striking face 702. The height ($H_{Low}$) of a lowest point of the aft slice is at least 40%, 45%, or 50% of the height of the geometric center of the striking face above the ground plane.

Golf club heads having aft slices 760 with the dimensions discussed above have been shown through testing to have improved aerodynamic properties similar to those discussed above with respect to FIGS. 9-11.

Figure 15:
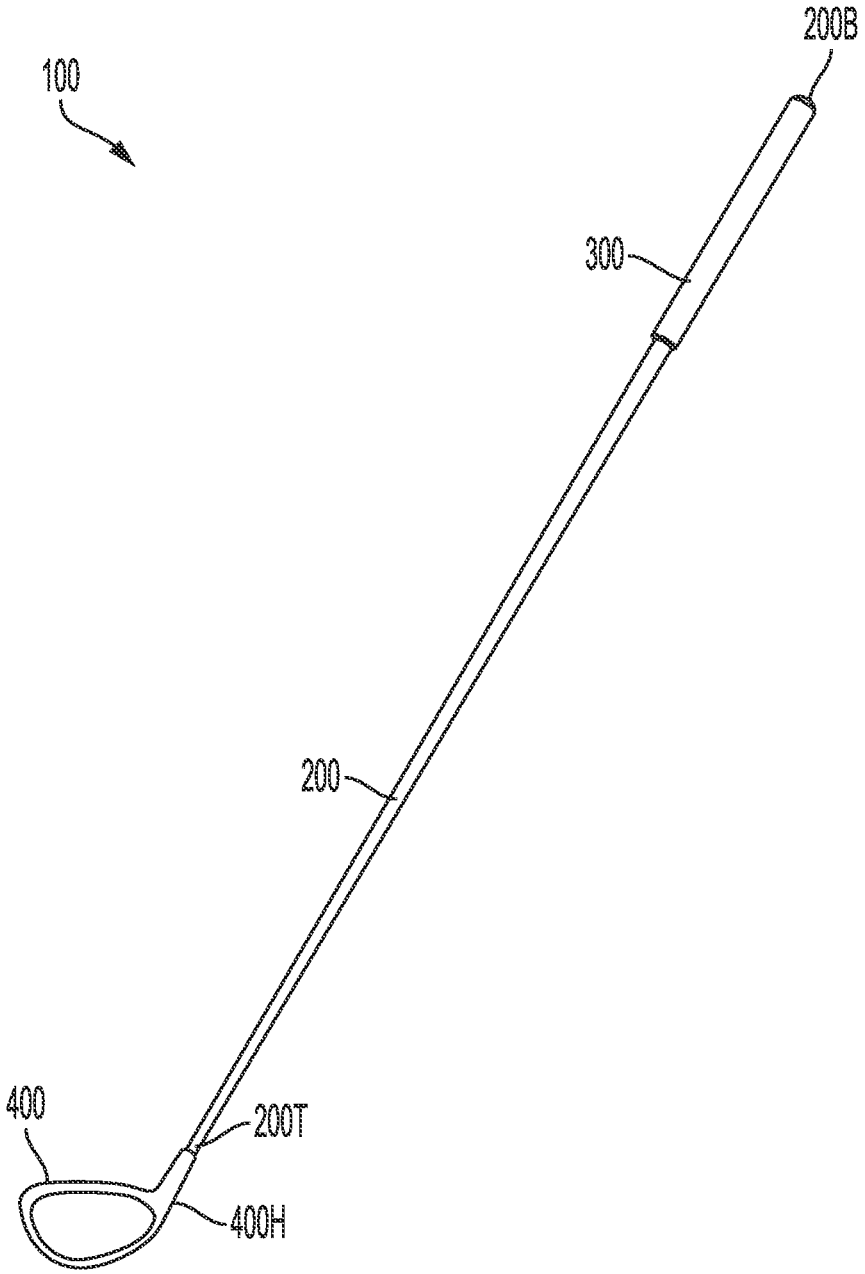
FIG. 15 depicts a perspective view of a golf club according to an example.

FIG. 15 depicts a perspective view of a golf club 100 according to an example. The golf club 100 includes a shaft 200 having a tip end 200T and a butt end 200B, a grip 300 coupled to the butt end 200B, and a golf club head 400 coupled to the tip end 200T. The golf club head 400 includes a hosel 400H disposed at a heel of the golf club head 400 and configured to couple to the tip end 200T of the shaft 200. The golf club head 400 may be any suitable type of golf club head, for example, a driver golf club head, a fairway metal golf club head, a hybrid golf club head, an iron golf club head, or a wedge golf club head. In some examples, the golf club head 400 may be a golf club head disclosed herein.

The golf club shaft 200 has an elasticity and inertia (EI) profile defined along its length from the tip end 200T to the butt end 200B. The value of the EI profile at a point along the shaft 200 is defined as a product of the (1) modulus of elasticity of the shaft material at the point and (2) the area moment of inertia at the point. Values of the EI profile are also referred to as bending stiffness values.

The EI profile of a golf club shaft can be measured, for example, by placing the shaft over two support points with a portion of the shaft between the two support points being unsupported. A force is then be applied to a measurement point on the shaft half way between the two support points to cause the shaft at the measurement point to deflect by a deflection distance. The bending stiffness at the measurement point can be determined where the applied force and the resultant deflection distance at the measurement point are both known. Accordingly, where the applied force is known, then the bending stiffness at the measurement point can be determined by measuring the deflection distance of the shaft at the measurement point. Similarly, if a force is applied at the measurement point until the shaft deflects by a known deflection distance, then the EI profile at the measurement point can be determined by measuring the force applied. Performing such measurements over a portion of the shaft provides the EI profile of the shaft over that portion.

Figure 17:
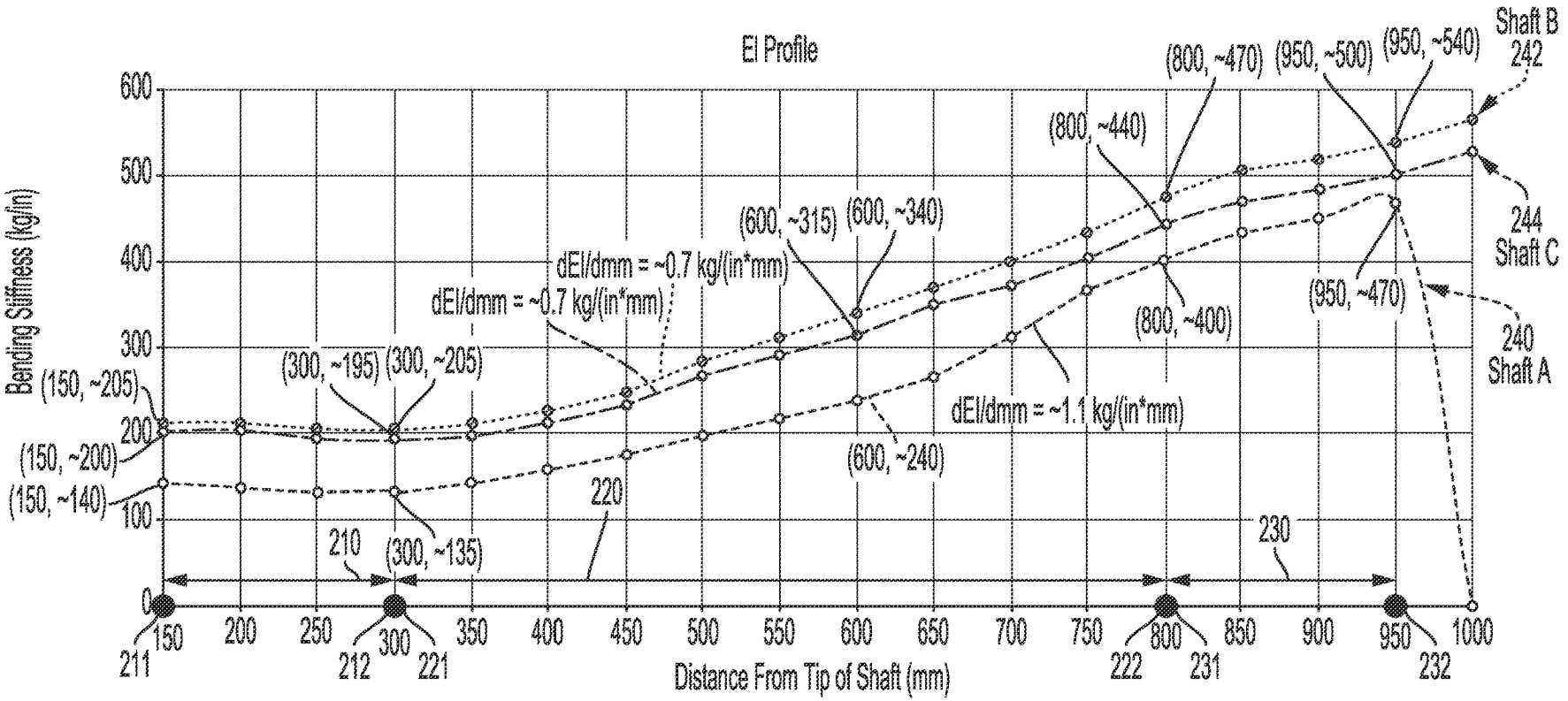
FIG. 17 depicts a graph with EI profiles of the three golf clubs of FIG. 16.

FIG. 16 depicts a chart with data of three golf club shafts, and FIG. 17 depicts a graph with EI profiles of the three golf club shafts of FIG. 16. The three golf club shafts of FIGS.

Figure 18:
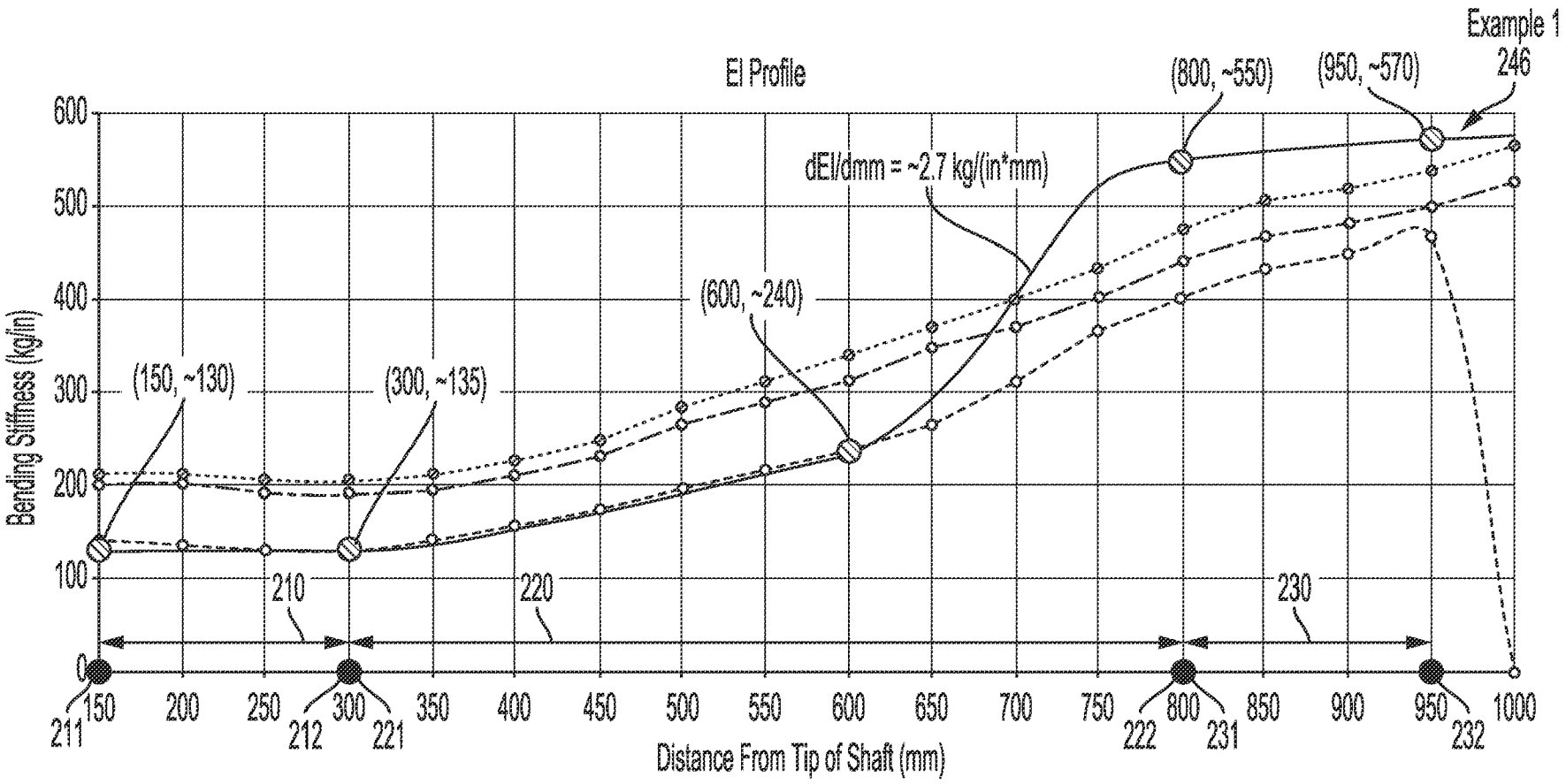
FIG. 18 depicts the graph of FIG. 17 with an EI profile of a first example golf club shaft according to the present disclosure.
Figure 19:
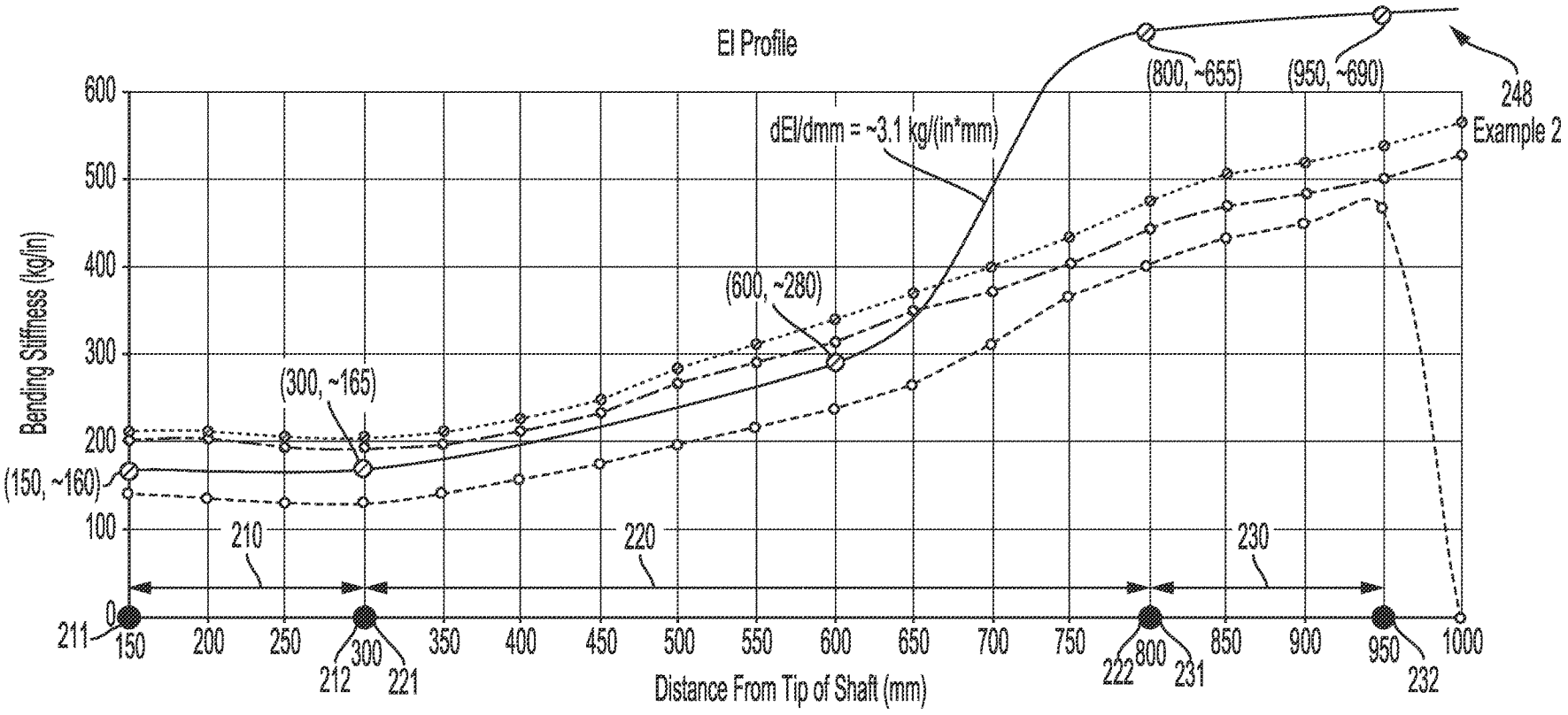
FIG. 19 depicts the graph of FIG. 17 with an EI profile of a second example golf club shaft according to the present disclosure.
Figure 20:
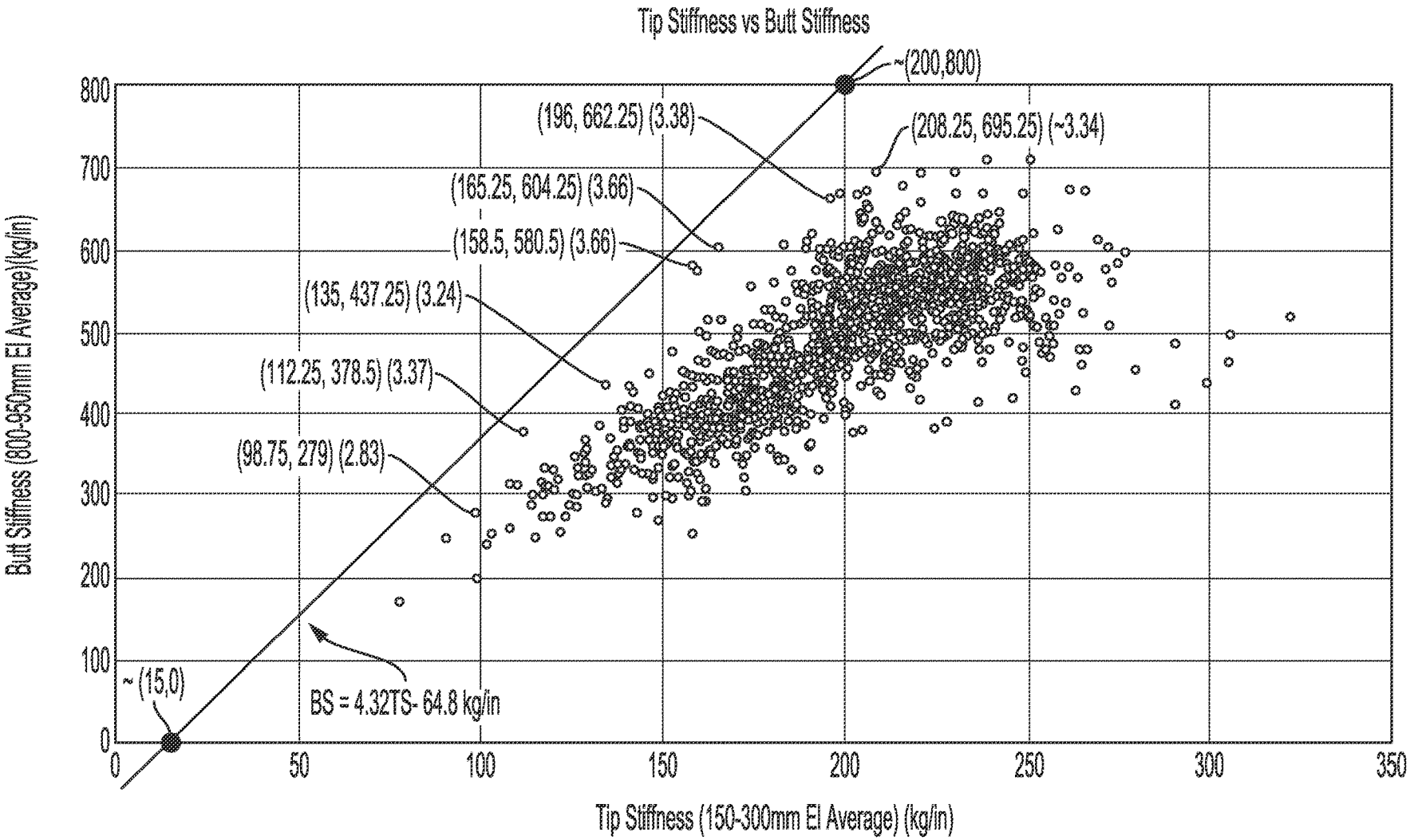
FIG. 20 depicts a scatter plot graph of an average bending stiffness of a butt end portion of a golf club shaft and an average bending stiffness of a tip end portion of the golf club shaft for a plurality of golf club shafts of the related art.
Figure 21:
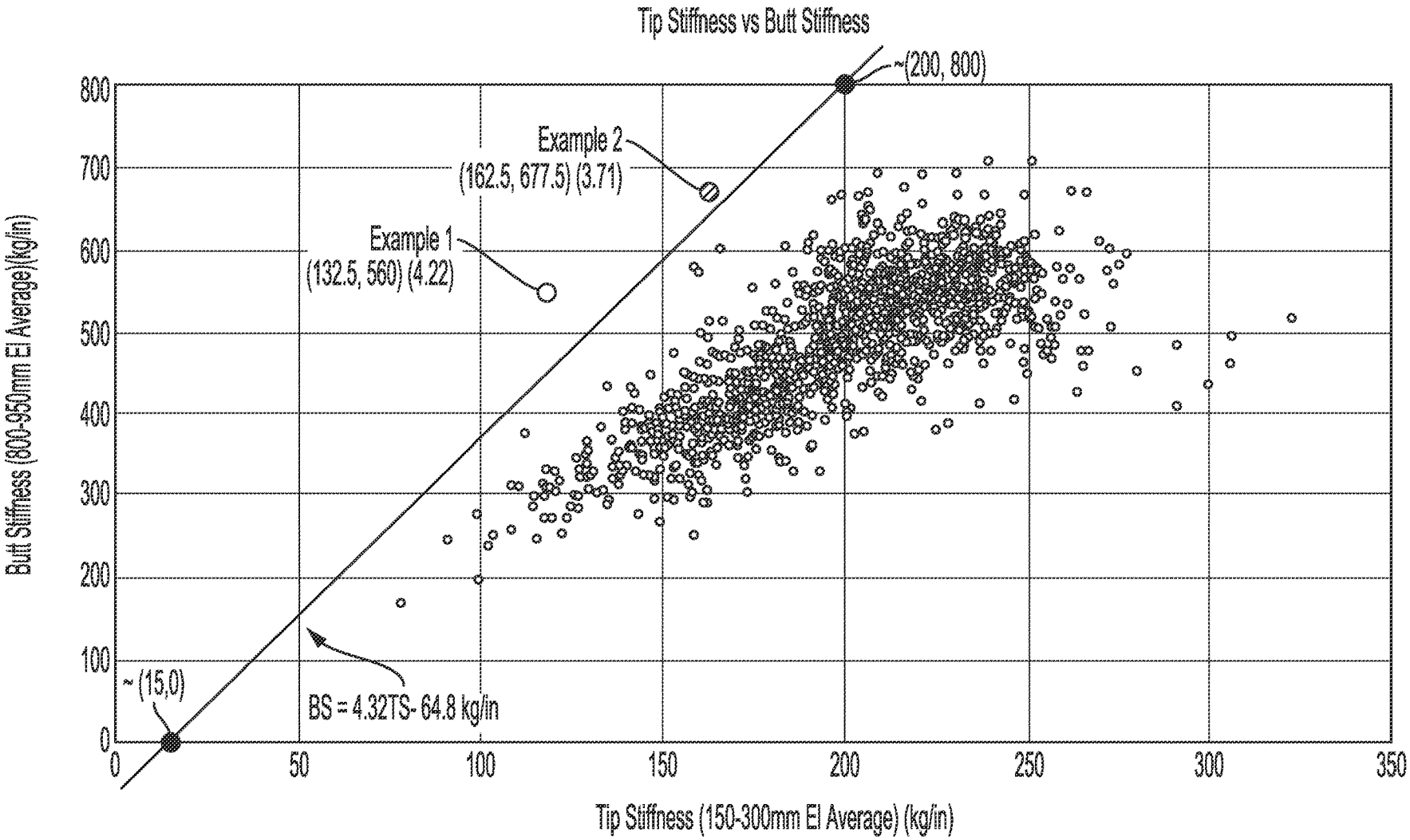
FIG. 21 depicts the scatter plot graph of FIG. 20 further including data for the first and second example golf club shafts of FIGS. 18 and 19.

16 and 17 include Shaft A having an EI profile 240, Shaft B having an EI profile 242, and Shaft C having an EI profile 244. FIG. 18 depicts the graph of FIG. 17 with an EI profile 246 of a first example golf club shaft according to the present disclosure, and FIG. 19 depicts the graph of FIG. 17 with an EI profile 248 of a second example golf club shaft according to the present disclosure. FIG. 20 depicts a scatter plot graph of an average bending stiffness of a butt end portion of a golf club shaft and an average bending stiffness of a tip end portion of the golf club shaft for a plurality of golf club shafts of the related art. FIG. 21 depicts the scatter plot graph of FIG. 20 further including data for the first and second example golf club shafts of FIGS. 18 and 19.

A golf club shaft 200 may be considered to have three spatial portions—a tip end portion, middle portion, and a butt end portion. These three spatial portions of the golf club shaft 200 according to an example are depicted in each of FIGS. 17-19 for ease of illustrating and explaining differences between EI profiles of the three golf club shafts in FIG. 17 and golf club shafts according to examples of the present disclosure. The golf club shaft 200 according to an example has at least a tip end portion 210 at or near the tip end 200T, a butt end portion 230 at or near the butt end 200B, and a middle portion 220 between the tip end portion 210 and the butt end portion 230. In this example, the golf club shaft 200 has a length of at least 950 mm from the tip end 200T to the butt end 200B. The tip end portion 210 has a first end 211 and a second end 212, and extends in a tip-to-butt direction from the first end 211 to the second end 212. The middle portion 220 has a first end 221 and a second end 222, and extends in the tip-to-butt direction from the first end 221 to the second end 222. The butt end portion 230 has a first end 231 and a second end 232, and extends in the tip-to-butt direction from the first end 231 to the second end 232. In this non-limiting example, the first and second ends 211 and 212 of the tip end portion 210 are respectively positioned at 150 mm and 300 mm from the tip end 200T, the first and second ends 221 and 222 of the middle portion 220 are respectively positioned at 300 mm and 800 mm from the tip end 200T, and the first and second ends 231 and 232 of the butt end portion 230 are respectively positioned at 800 mm and 950 mm from the tip end 200T.

However, examples of the present disclosure are not limited thereto, and the first and second ends of each of the tip end portion 210, the middle portion 220, and the butt end portion 230 may have different dimensions along the length of the golf club shaft 200 subject to the requirement that the middle portion 220 be between the tip end portion 210 and the butt end portion 230. The first point 221 of the middle portion 220 may overlap with (e.g., be the same as) the second point 212 of the tip end portion 210, or the first point 221 of the middle portion 220 may be at a position farther along the shaft 200 in the tip-to-butt direction than the second point 212 of the tip end portion 210 is. The first point 231 of the butt end portion 230 may overlap with (e.g., be the same as) the second point 222 of middle portion 220, or the first point 231 of the butt end portion 230 may be at a position farther along the shaft 200 in the tip-to-butt direction than the second point 222 of the middle portion 220 is.

In some examples, the tip end portion 210 may extend for a first length (e.g., 50 mm, 100 mm, 150 mm, 200 mm, 250 mm, or 300 mm) in the tip-to-butt direction from the tip end 200T toward the butt end 200B. That is, although the first point 211 of the tip end portion 210 is shown as being at 150 mm from the tip end 200T in FIGS. 17 and 18 in accordance with some examples, the first point 211 of the tip end portion 210 may be at the tip end 200T in some other examples. In some examples, the butt end portion 230 may extend for a third length (e.g., 50 mm, 100 mm, 150 mm, 200 mm, 250 mm, or 300 mm) in a butt-to-tip direction from the butt end 200B toward the tip end 200T. That is, although the second point 232 of the butt end portion 230 is shown as being at 950 mm from the tip end 200T in FIGS. 17 and 18 in accordance with some examples, the second point 232 of the butt end portion 230 may be at the butt end 200B in some other examples. In some examples, the middle portion 220 has a second length (e.g., 100 mm, 200 mm, 300 mm, 400 mm, 500 mm, or 600 mm) and extends in the tip-to-butt direction from the first point 221 to the second point 222. For example, the middle portion 220 may have a length of 200 mm and may extend in the tip-to-butt direction from the first point 221 positioned at 600 mm to the second point 222 positioned at 800 mm.

Referring to FIGS. 17-21, the golf club shaft 200 according to examples of the present disclosure has a rapid increase in bending stiffness in the middle portion 220 compared to golf club shafts of the related art. This rapid increase results in the golf club shaft 200 having, among other things, a higher ratio of an average bending stiffness in the butt end portion 230 to an average bending stiffness in the tip end portion 210, compared to other golf club shafts.

When bending stiffness in a golf club shaft at the butt end portion is increased (without increasing the bending stiffness at the tip end portion), for example, by rapidly increasing a bending stiffness gradient in the middle portion, then deflection in the golf club shaft at or near the player's hands during a golf club shot is reduced without decreasing the deflection in the golf club shaft near the golf club head. Deflection in the golf club shaft near the player's hands may have a biomechanical effect of slowing down the player's hands during the swing, thereby reducing golf club speed. However, deflection near the golf club head is desirable in the sense that it increases the golf club speed. Accordingly, rapidly increasing the bending stiffness gradient in the middle portion of the golf club shaft to provide a high ratio of average bending stiffness in the butt end portion to average bending stiffness in the tip end portion improves golf club speed.

The bending stiffness of a portion of the golf club shaft 200 can be controlled by various means. Selecting a material that has a higher modulus of elasticity will increase the bending stiffness. Increasing the shaft material geometry (e.g., increasing the diameter of the shaft) will increase the bending stiffness. Adding plies at 0 degrees (i.e., adding plies arranged along the length of the shaft) will increase the bending stiffness more than if the plies are added at 90 degrees (i.e., adding plies wrapped around the circumference of the shaft). Adding plies at 30 degrees, 45 degrees, and 60 degrees will also increase the bending stiffness, but not as much as plies at 0 degrees. Accordingly, and as a non-limiting example, a rapid increase in bending stiffness in the middle portion 220 of the golf club shaft 200 can be achieved by one or more of the following: (1) using a material in the butt end portion 230 that has a greater modulus of elasticity; (2) using a material in the tip end portion 210 that has a smaller modulus of elasticity; (3) increasing the diameter of the shaft 200 in the butt end portion 230; (4) decreasing the diameter of the shaft 200 in the tip end portion 210; (5) increasing the number of 90 degree plies in the butt end portion 230; and/or (6) decreasing the number of 90 degree plies in the tip end portion 210.

Referring to FIGS. 17-19, data is provided at five points on the EI profile for each of the three golf club shafts depicted in FIG. 17, the Example 1 Shaft depicted in FIG.

18, and the Example 2 Shaft depicted in FIG. 19. The five data points include a first data point at 150 mm, a second data point at 300 mm, a third data point at 600 mm, a fourth data point at 800 mm, and a fifth data point at 950 mm. An approximate maximum rate of increase of the EI profile (i.e., dEI/dmm) is also provided for each of the three shafts depicted in FIG. 17, the first example shaft depicted in FIG. 18, and the second example shaft depicted in FIG. 19.

As shown in FIG. 17, the approximate maximum rate of change of the EI profile 240 for the Shaft A, of the EI profile 242 for the Shaft B, and of the EI profile 244 for the Shaft C is 1.1 kg/(in*mm), 0.7 kg/(in*mm), and 0.7 kg/(in*mm), respectively. In contrast, the maximum rate of change of the EI profile 246 for the first example shaft and the EI profile 248 for the second example shaft shown in FIGS. 18 and 19 are higher at approximately 2.7 kg/(in*mm) and 3.1 kg/(in*mm), respectively. In each of the first and second examples, the maximum rate of change is at a point within the range of 600 mm from the tip end 200T to 800 mm from the tip end 200T.

The golf club shaft 200 according to some examples has a rate of change (e.g., a maximum rate of change) in bending stiffness in the tip-to-butt direction at a point along the shaft 200 that is at least 1.4 kg/(in*mm), for example, at least 1.6 kg/(in*mm), at least 1.8 kg/(in*mm), at least 2.2 kg/(in*mm), at least 2.5 kg/(in*mm), at least 2.8 kg/(in*mm), at least 3.2 kg/(in*mm), at least 3.5 kg/(in*mm), at least 3.8 kg/(in*mm), at least 4.2 kg/(in*mm), or at least 4.5 kg/(in*mm). In some examples, the rate of change of bending stiffness at the point is within any range subsumed by the range of 1.5 kg/(in*mm) to 5.0 kg/(in*mm). The point where the maximum rate of change occurs may be in the middle portion 220, but the present disclosure is not limited thereto. In some examples, the point where the maximum rate of change occurs is within the range of 300 mm to 800 mm from the tip end 200T of the shaft 200, for example, within the range of 600 mm and 800 mm from the tip end 200T of the shaft 200.

In some examples, a difference in bending stiffness in the shaft 200 between two points in the middle portion 220 of the shaft 200 is at least the product of (i) a difference in distance, as measured from the tip end 200T, between the two points and (ii) 1.4 kg/(in*mm), 1.6 kg/(in*mm), 1.8 kg/(in*mm), 2.0 kg/(in*mm), 2.2 kg/(in*mm), 2.4 kg/(in*mm), 2.6 kg/(in*mm), 2.8 kg/(in*mm), 3.0 kg/(in*mm), 3.2 kg/(in*mm), 3.4 kg/(in*mm), 3.6 kg/(in*mm), 3.8 kg/(in*mm), 4.0 kg/(in*mm), 4.2 kg/(in*mm), 4.4 kg/(in*mm), and 4.6 kg/(in*mm). The difference in distance from the tip end 200T between the two points may be, for example, between 2-10 mm, 10-20 mm, 20-40 mm, 40-70 mm, 70-100 mm, 100-200 mm, or 200-300 mm. The two points may be positioned anywhere along the shaft 200, subject to the requirement that the two points are both within, or at endpoints of, the middle portion 220.

In some examples, a difference in bending stiffness in the shaft 200 between a point at 800 mm from the tip end 200T and a point at 600 mm from the tip end 200T is at least 200 kg/in, at least 220 kg/in, at least 240 kg/in, at least 250 kg/in, at least 260 kg/in, at least 280 kg/in, at least 300 kg/in, at least 320 kg/in, at least 340 kg/in, at least 360 kg/in, at least 380 kg/in, at least 400 kg/in, at least 420 kg/in, at least 440 kg/in, at least 460 kg/in, at least 480 kg/in, at least 500 kg/in, at least 520 kg/in, at least 540 kg/in, at least 560 kg/in, at least 580 kg/in, or at least 600 kg/in.

For example, as shown in FIG. 18, the Example 1 Shaft has a difference in bending stiffness between a point at 800 mm from the tip end 200T (i.e., the fourth point) and a point at 600 mm from the tip end 200T (i.e., the third point) of 310 kg/in. Also, as shown in FIG. 19, the Example 2 Shaft has a difference in bending stiffness between a point at 800 mm from the tip end 200T (i.e., the fourth point) and a point at 600 mm from the tip end 200T (i.e., the third point) of 385 kg/in. In contrast to the Example 1 Shaft and the Example 2 Shaft, and as shown in FIG. 17, a difference in bending stiffness between a point at 800 mm from the tip end 200T (i.e., the fourth point) and a point at 600 mm from the tip end 200T (i.e., the third point) in the Shaft A, Shaft B, and Shaft C is 160 kg/in, 130 kg/in, and 125 kg/in, respectively.

Referring again to FIG. 17, the average rate of change in bending stiffness in the butt end portion 230 (i.e., the portion between the fourth and fifth data points) of the Shaft A, Shaft B, and Shaft C is 0.47 kg/(in*mm), 0.47 kg/(in*mm), and 0.40 kg/(in*mm), respectively. The approximate maximum rate of change of bending stiffness for each of the Shafts A-C is in the middle portion 220, and a ratio of a rate of change of bending stiffness at any point in the middle portion 220 to the average rate of change in the butt end portion 230 is no more than 2.35, 1.49, and 1.75 in the Shaft A, Shaft B, and Shaft C, respectively. Approximations of values between any two data points among the five data points shown on the EI profile of any of the Shaft A, the Shaft B, the Shaft C, the Example 1 Shaft, and the Example 2 Shaft is made by using the approximate values of the two data points shown in the graph, and by linearly approximating the EI profile between the two data points. Accordingly, an approximated average rate of change in an EI profile between any two of the five data points shown on the EI profile is equal to (1) the difference between the EI values at the two points divided by (2) the distance between the two points. Also, an approximated average value of the EI profile between the two data points is the average of the EI profile at the two data points.

The average rate of change of bending stiffness in the butt end portion 230 of the first and second example shafts, as shown in FIGS. 18 and 19, is 0.13 kg/(in*mm) and 0.17 kg/(in*mm), respectively. Accordingly, in the first and second example shafts, a ratio of a rate of change of bending stiffness at a point along the middle portion 220 to the average rate of change in bending stiffness in the butt end portion 230, is at least 20.25 and 18.6, respectively, and thus, is higher than in other shafts. As discussed above, the increased ratio provided by the present technology provides a functional difference that results in higher club and ball speeds due at least in part to the shaft altering a biomechanical response of the golfer using the golf club including the example shafts.

Although the EI profile 246 in the first example and the EI profile 248 in the second example are shown as plateauing in the butt end portion 230, examples of the present disclosure are not limited thereto. For instance, the EI profile of golf club shaft 200 according to some examples may have a larger average rate of change in the butt end portion 230, for example, within the range of 0.2 kg/(in*mm) to 1.0 kg/(in*mm).

In some examples, a rate ratio of the rate of change in bending stiffness at a third point in the middle portion 220 to the average rate of change in bending stiffness in the butt end portion 230 is at least a threshold value, such as at least 2.7, at least 3.5, at least 5.0, at least 7.5, at least 10.0, at least 12.5, at least 15.0, at least 17.5, or at least 20.0. In some examples, the rate ratio is at least the threshold value, and the third point is at a point where the rate of change in the bending stiffness is a maximum. In some examples, the rate ratio is at least the threshold value and the third point is at a distance from the tip end 200T equal to 500 mm, 510 mm, 520 mm, 530 mm, 540 mm, 550 mm, 560 mm, 570 mm, 580 mm, 590 mm, 600 mm, 610 mm, 620 mm, 630 mm, 640 mm, 650 mm, 660 mm, 670 mm, 680 mm, 690 mm, 700 mm, 710 mm, 720 mm, 730 mm, 740 mm, 750 mm, 760 mm, 770 mm, 780 mm, 790 mm, or 800 mm. In some examples, the rate ratio is at least the threshold value, and the third point is at any one of multiple points, or at any point within one or more ranges of distances from the tip end 200T. For example, the rate ratio may be at least the threshold value where the third point is at any point from 675 mm from the tip end 200T to 725 mm from the tip end 200T. In some examples, the rate ratio is at least the threshold value where the third point is at any point within a range of distances from the tip end 200T that spans 10 mm, 20 mm, 30 mm, 40 mm, 50 mm, 60 mm, 70 mm, 80 mm, 90 mm, 100 mm, 110 mm, 120 mm, 130 mm, 140 mm, 150 mm, 160 mm, 170 mm, 180 mm, 190 mm, or 200 mm, and that is centered at a point having a maximum rate of change of bending stiffness.

As shown in FIG. 17, the average bending stiffness in the butt end portion 230 of the Shaft A, Shaft B, and Shaft C is 435 Kg/(in*mm), 505 Kg/(in*mm), and 470 Kg/(in*mm), respectively. The average bending stiffness in the tip end portion 210 of the Shaft A, Shaft B, and Shaft C is 137.5 Kg/(in*mm), 205 Kg/(in*mm), and 197.5 Kg/(in*mm), respectively. Accordingly, a ratio of the average bending stiffness in the butt end portion 230 to the average bending stiffness in the tip end portion 210 of the Shaft A, Shaft B, and Shaft C is 3.16, 2.46, and 2.38, respectively.

FIG. 20 shows the average bending stiffness in the butt end portion 230 and the average bending stiffness in the tip end portion 210 for several other related art shafts. Data values for some of these data points are provided in the form of (TS, BS) (R), wherein TS is the average bending stiffness in the tip end portion 210, BS is the average bending stiffness in the butt end portion 230, and R is the ratio of the BS to TS. As shown in FIG. 19, golf clubs in the related art have a ratio R equal to or less than 3.66 and are tightly grouped together in the scatter plot in a region below the line defined as:

$$BS=4.32TS-64.8 \text{ kg/in} \quad \text{[Equation 1]}$$

In contrast to the golf club shafts of the related art, the golf club shaft 200 according to examples of the present disclosure has a much higher ratio of an average bending stiffness of the butt end portion 230 to an average bending stiffness of the tip end portion 210, for example, greater than 3.70, greater than 3.80, greater than 3.90, greater than 4.00, greater than 4.10, greater than 4.20, greater than 4.30, greater than 4.40, greater than 4.50, greater than 4.60, greater than 4.70, greater than 4.80, greater than 4.90, greater than 5.00, greater than 5.10, greater than 5.20, greater than 5.30, greater than 5.40, greater than 5.50, greater than 5.60, greater than 5.70, greater than 5.80, greater than 5.90, or greater than 6.00. Indeed, the tight clustering of the other shafts below the line indicates that those in the industry had a well-established wisdom for bending stiffnesses in golf club shafts. The present technology proceeds against that wisdom and provides a new EI profile for a golf club shaft that provides improved results despite being against that which was generally accepted.

Accordingly, the average bending stiffness of the butt end portion 230 and the average bending stiffness of the tip end portion 210 may satisfy the following inequality:

$$BS \geq 4.32TS-64.8 \text{ kg/in} \quad \text{[Equation 2]}$$

For example, as shown in FIGS. 18 and 21, the average bending stiffnesses in the butt and tip end portions 230 and 210 of the first example shaft are 560 kg/in and 132.5 kg/in, respectively, and a ratio of the average bending stiffness in the butt end portion 230 to the average bending stiffness in the tip end portion 210 in the first example shaft is 4.22. In the second example shaft, as shown in FIGS. 19 and 21, the average bending stiffnesses in the butt and tip end portions 230 and 210 are 677.5 kg/in and 162.5 kg/in, respectively, and a ratio of the average bending stiffness in the butt end portion 230 to the average bending stiffness in the tip end portion 210 in the second example shaft is 3.71.

The golf club shaft 200 according to examples of the present disclosure may have a smaller diameter at the tip end 200T compared to golf club shafts of the related art. In some examples, the diameter at the tip end 200T is less than 0.335 inches, less than 0.330 inches, less than 0.325 inches, less than 0.320 inches, less than 0.315 inches, less than 0.310 inches, less than 0.305 inches, less than 0.300 inches, less than 0.295 inches, less than 0.290 inches, less than 0.285 inches, less than 0.280 inches, less than 0.275 inches, less than 0.270 inches, less than 0.265 inches, less than 0.260 inches, less than 0.255 inches, less than 0.250 inches, less than 0.245 inches, less than 0.240 inches, less than 0.235 inches, or less than 0.230 inches. In some examples, the diameter at the tip end 200T is within the range of 0.250 inches to 0.280 inches. Decreasing the diameter of the shaft 200 at the tip end 200T of the shaft 200 reduces drag on the golf club 100 during a swing, thereby improving the golf club head speed and golf ball speed.

Although the diameter of the shaft 200 generally increases in the tip-to-butt direction along the length of the shaft 200 from the tip end 200T to the butt end 200B, the diameter may remain constant for a set distance in the tip-to-butt direction from a point at or near the tip end 200T toward the butt end 200B. In some examples, the diameter may remain constant for a distance within a range of 0.5 inches to 4.0 inches or any range subsumed therein. Accordingly, when the shaft 200 is coupled to a hosel (or other device for coupling the shaft 200 to the golf club head 400) by inserting the tip end 200T into the hosel by a short distance (e.g., by 0.5 inches to 1.5 inches), the shaft 200 may have the same diameter at a point along the shaft 200 adjacent to the hosel as it does at the tip end 200T that is within the hosel. For example, the shaft 200 may have a constant diameter of 0.280 inches for a distance of 3.0 inches along the length of the shaft 200 from the tip end 200T toward the butt end 200B, the shaft 200 may be inserted into a hosel by 1.0 inches, and the shaft 200 may have a constant diameter of 0.280 inches for a distance of 2.0 inches along the length of the shaft 200 from a point adjacent to the hosel towards the butt end 200B.

Figure 22:
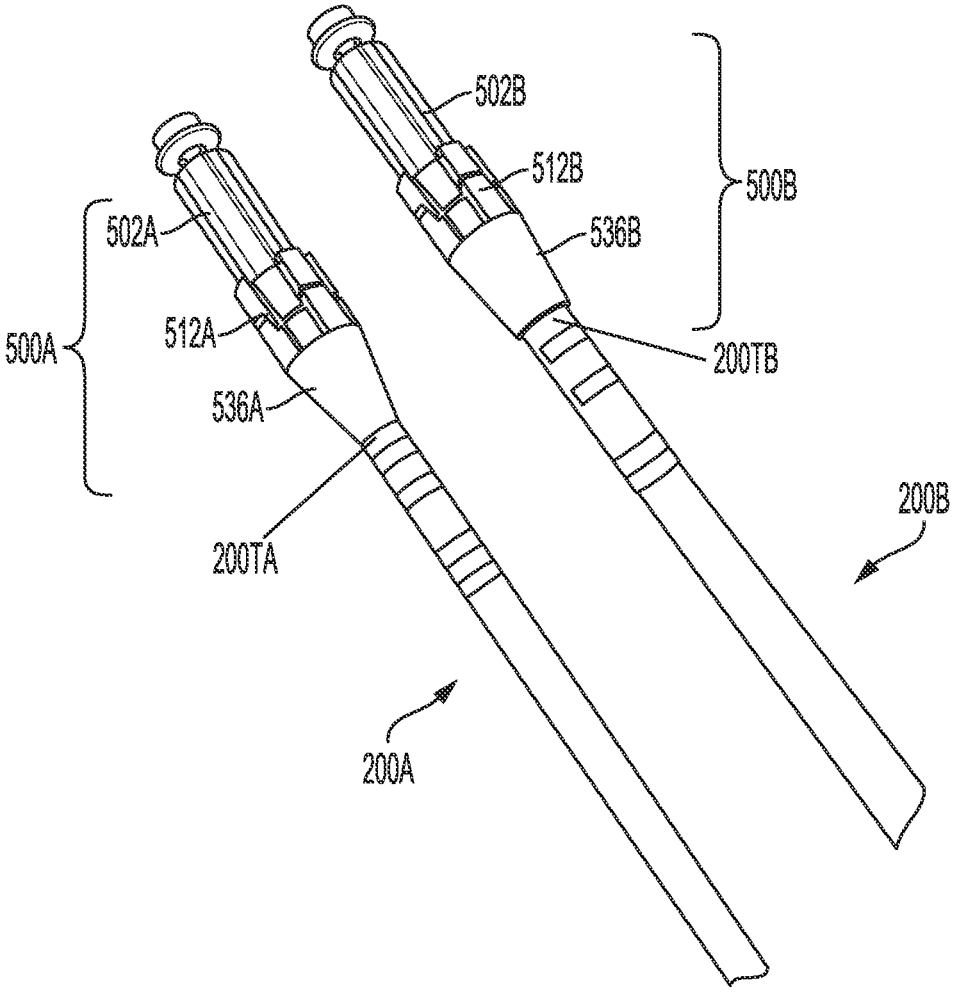
FIG. 22 depicts a photograph of a portion of two golf club shafts near a tip end of the two golf club shafts.

FIG. 22 illustrates a portion of two golf club shafts 200A and 200B and adjustable hosel sleeves 500A and 500B respectively coupled to the two golf club shafts 200A and 200B at tip ends 200TA and 200TB of the two golf club shafts 200A and 200B. The adjustable hosel sleeve 500A includes a connection piece 502A, adjustable hosel components 512A (e.g., rotatable components for changing loft and/or lie settings), and a ferrule 536A. The adjustable hosel sleeve 500B includes a connection piece 502B, adjustable hosel components 512B, and a ferrule 536B. The connection pieces 502A and 502B are configured to engage with a golf club head to couple the golf club head to the shafts 200A and 200B. The hosel sleeves 500A and 500B are coupled to the golf club shafts 200A and 200B by inserting the tip ends 200TA and 200TB into the hosel sleeves 500A and 500B and securely tightening the hosel sleeves 500A and 500B onto the golf club shafts 200A and 200B. Accordingly, although the tip ends 200TA and 200TB are illustrated as being adjacent to the ferrules 536A and 536B of the hosel sleeves 500A and 500B, the tip ends 200TA and 200TB are actually positioned a short distance into the hosel sleeves 500A and 500B. The diameter of the shaft 200A at the tip end 200TA and at a point adjacent to the hosel sleeve 500A is 0.278 inches, and the diameter of the shaft 200B at the tip end 200TB and at a point adjacent to the hosel sleeve 500B is 0.335 inches. The reduced diameter of the tip end 200TA of shaft 200A results in higher swing speeds due to the reduced drag as compared to the larger diameter for the tip end 200TB of the shaft 200B, as discussed further herein.

Figure 23:
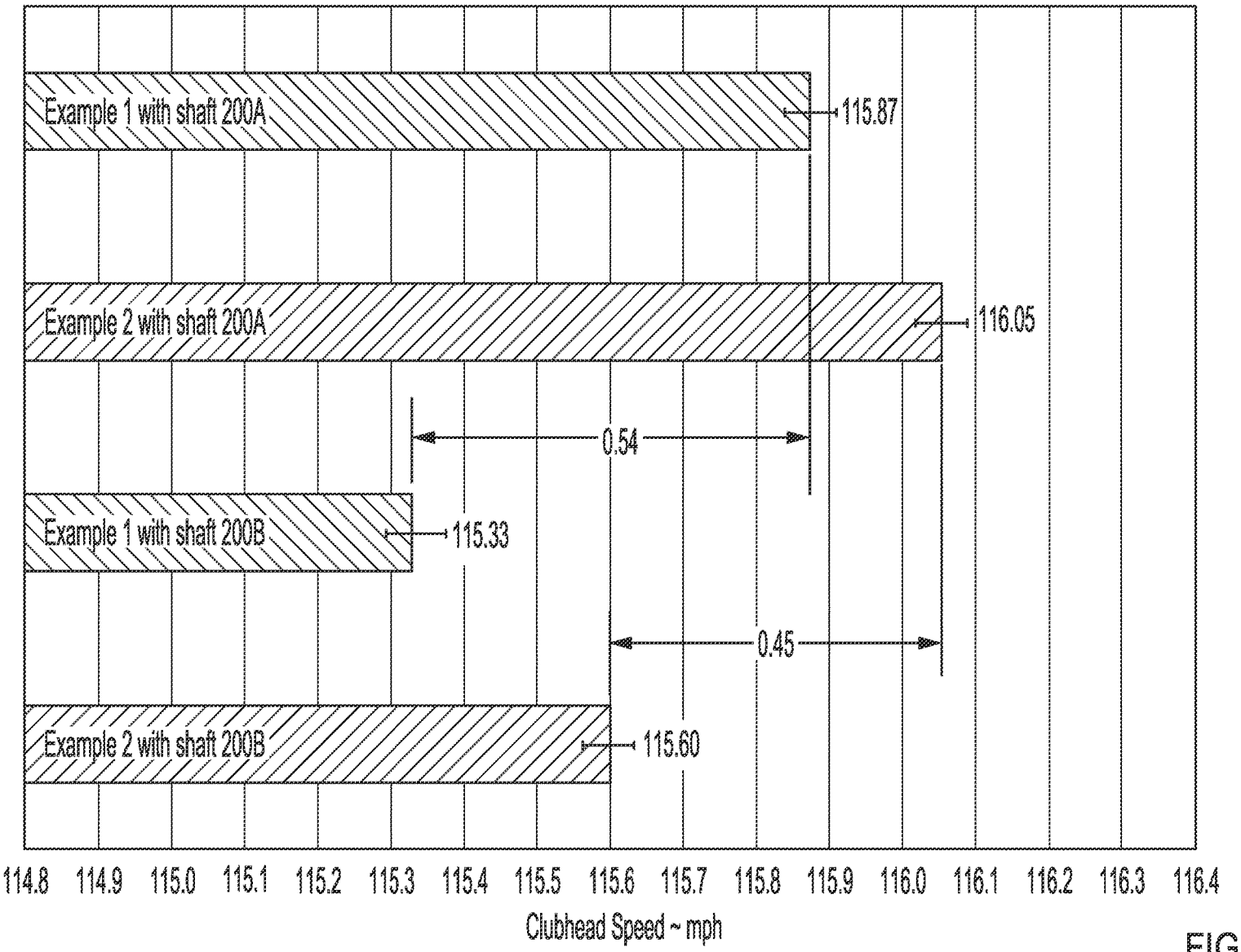
FIG. 23 depicts a graph with test data of four golf club head speeds.

FIG. 23 depicts a graph with test data of four golf club head speeds: one for an Example 1 club head attached to the golf club shaft 200A depicted in FIG. 22, one for an Example 2 club head attached to the golf club shaft 200A depicted in FIG. 22, one for the Example 1 club head attached to the golf club shaft 200B depicted in FIG. 22, and one for the Example 2 club head attached to the golf club shaft 200B depicted in FIG. 22. The golf club shafts 200A and 200B were manufactured with similar properties other than diameter at the tip ends 200TA and 200TB, except that the torque and tip flex of the golf club shaft 200B was modified so that a proper comparison between resulting golf club head speeds using the two shafts 200A and 200B could be provided.

It was found that the Example 1 club head had an average speed of 115.33 mph when attached to the golf club shaft 200B and an average speed of 115.87 mph when attached to the golf club shaft 200A. It was also found that the Example 2 club head had an average speed of 115.60 mph when attached to the golf club shaft 200B and an average speed of 116.05 mph when attached to the golf club shaft 200A. Standard deviations for each golf club head speed are illustrated as left-to-right bars centered at the corresponding average golf club head speed. Accordingly, the average speed of the Example 1 club head increased by 0.54 mph when the shaft diameter at the tip was reduced from 0.335 inches (i.e., when the golf club shaft 200B was used) to 0.278 inches (i.e., when the golf club shaft 200A was used), and the average speed of the Example 2 club head increased by 0.45 mph when the shaft diameter at the tip was reduced from 0.335 inches (i.e., when the golf club shaft 200B was used) to 0.278 inches (i.e., when the golf club shaft 200A was used). These increases in golf club head speed are significantly greater than an increase of approximately 0.3 mph that would have been expected theoretically from modeling a golf club shaft as a cylinder and reducing the diameter from 0.335 inches to 0.278 inches.

The golf club shaft 200 and the grip 300 of the golf club 100 according to examples of the present disclosure may have reduced weight compared to golf clubs of the related art. Decreasing the weight of the shaft 200 and grip 300 of the golf club 100 according to some examples increases golf club head speed and golf ball speed by allowing the player to swing the golf club 100 faster. The weight of the shaft 200 can be reduced, for example, by using a material for the shaft 200 with a lower density, reducing the amount of material used in the shaft 200, and/or by removing flags, or sheets of material, in the shaft 200. The weight of the grip 300 may be reduced, for example, by using a material for the grip 300 with a lower density, reducing the amount of material used in the grip 300, and/or adding ribs, or elongated stiffened portions in the grip 300.

The golf club shaft 200 according to examples has a mass of less than 55 g, less than 54 g, less than 53 g, less than 52 g, less than 51 g, less than 50 g, less than 49 g, less than 48 g, less than 47 g, less than 46 g, less than 45 g, less than 44 g, less than 43 g, less than 42 g, less than 41 g, or less than 40 g. The grip 300 according to examples has a mass of less than 45 g, less than 44 g, less than 43 g, less than 42 g, less than 41 g, less than 40 g, less than 39 g, less than 38 g, less than 37 g, less than 36 g, less than 35 g, less than 34 g, less than 33 g, less than 32 g, less than 31 g, or less than 30 g.

According to examples, a sum of the mass of the golf club shaft 200 and the mass of the grip 300 is less than 100 g, less than 99 g, less than 98 g, less than 97 g, less than 96 g, less than 95 g, less than 94 g, less than 93 g, less than 92 g, less than 91 g, less than 90 g, less than 89 g, less than 88 g, less than 87 g, less than 86 g, less than 85 g, less than 84 g, less than 83 g, less than 82 g, less than 81 g, less than 80 g, less than 79 g, less than 78 g, less than 77 g, less than 76 g, less than 75 g, less than 74 g, less than 73 g, less than 72 g, less than 71 g, or less than 70 g.

Simply reducing the mass of the shaft and/or the grip, however, may result in negative or undesired effects. For example, reducing the mass of the shaft 200 results in a fade bias, while reducing the mass of the grip 300 results in a draw bias. These biases result from a biomechanical effect of the decreased masses of the shaft 200 and grip 300 on the player's swing. That is, as the weight of the shaft 200 is decreased, the player's hands rotate slower during the player's swing, causing the clubface to open more and resulting in a fade bias. Conversely, as the weight of the grip 300 is decreased, the player's hands rotate faster, causing the clubface to close more and resulting in a draw bias. Accordingly, reducing the mass of both the shaft 200 and grip 300 can result in a fade or draw bias unless a mass ratio of the mass of the shaft 200 to the mass of the grip 300 is controlled to avoid either the fade or draw bias.

Therefore, in examples of the present disclosure, the mass ratio of the mass of the shaft 200 to the mass of the grip 300 is within a range of 1.0 to 1.5, within the range of 1.1 to 1.3, or about 1.25. At such ratios, the introduction of fade and/or draw biases due to mass changes may be substantially avoided. The mass ratio of the mass of the shaft 200 to the mass of the grip 300 may be within any range subsumed within the range of 1.0 to 1.5, for example, within a range of 1.05 to 1.45, within a range of 1.1 to 1.4, within a range of 1.15 to 1.35, or within a range of 1.2 to 1.3. In some examples, the mass ratio of the mass of the shaft 200 to the mass of the grip 300 is greater than 1.00, greater than 1.05, greater than 1.10, greater than 1.15, greater than 1.20, greater than 1.25, greater than 1.30, greater than 1.35, greater than 1.40, or greater than 1.45. In some examples, the mass ratio of the mass of the shaft 200 to the mass of the grip 300 is less than 1.50, less than 1.45, less than 1.40, less than 1.35, less than 1.30, less than 1.25, less than 1.20, less than 1.15, less than 1.10, or less than 1.05.

In examples where the reduced mass of the shaft 200 and grip 300 results in a fade or draw bias, the bias may be corrected by adjusting the lie angle of the golf club head 400. For example, the golf club 100 may include an adjustable hosel (e.g., the SUREFIT hosel system) that can be used to control the lie angle to correct the bias.

FIG. 24 depicts a chart providing data for the shafts of two golf clubs: an Example 1 golf club having a shaft mass of 55.93 g, and an Example 2 golf club having a smaller shaft mass of 47.27 g. The Example 1 golf club shaft and the Example 2 golf club shaft have similar characteristics, including flex type, balance point, torque, base frequency, and tip frequency. The Example 2 golf club shaft differs from the Example 1 golf club shaft primarily in that its weight is substantially less. Each of the Example 1 golf club and the Example 2 golf club includes the SUREFIT hosel System. FIG. 25 depicts a chart with test ball flight data obtained from using the Example 1 golf club and the Example 2 golf club of FIG. 24.

In each of the top, middle, and bottom rows shown in the chart in FIG. 25, the Example 1 golf club used a standard grip having a mass of 52*g* with the A1 setting of the SUREFIT hosel system. The A1 setting on the SUREFIT hosel system results in a standard loft and standard lie for the golf club head. In the top row, the Example 2 golf club used the standard grip with the A1 setting, which resulted in maximum and average increases in golf ball speed of 1.4 mph and 0.4 mph, respectively, compared to the Example 1 golf club. However, a fade bias also occurred, causing the ball to travel an average of 3.7 yards to the right compared to the Example 1 golf club. In the middle row, the Example 2 golf club used a light grip having a smaller mass of 31*g* with the A1 settings, which resulted in maximum and average increases in golf ball speed of 1.7 mph and 0.6 mph compared to the Example 1 golf club. However, a draw bias also occurred, causing the ball to travel an average of 5.5 yards to the left compared to the Example 1 golf club. In the bottom row, the Example 2 golf club used the light grip with the B1 setting of the SUREFIT hosel system, to correct the draw bias. The B1 setting configures the golf club head to have a standard loft and the lie angle to be 0.75 degrees flat. This resulted in a maximum and average increase in ball speed of 1.7 mph and 0.4 mph, respectively, compared to the Example 1 golf club. Substantially no fade or draw bias occurred.

According to examples of the present disclosure, features of the golf club 100, including the EI profile of the shaft 200, the diameter of the shaft 200 at the tip end 200T, and the masses of the shaft 200 and grip 300, may be used individually or in any combination with each other. In addition, the improved shafts may be coupled to the golf club heads discussed herein to form an overall improved golf club that captures the aerodynamic improvement of the club head, the aerodynamic and/or weight improvements of the shaft and/or grip, and/or the improved EI profile of the shaft—resulting in higher club head speeds and increased ball flight.

Although specific devices have been recited throughout the disclosure as performing specific functions, one of skill in the art will appreciate that these devices are provided for illustrative purposes, and other devices may be employed to perform the functionality disclosed herein without departing from the scope of the disclosure. This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A golf club comprising:

a golf club head;

a grip; and a shaft having a tip end and a butt end, the golf club head being coupled to the shaft at the tip end, the grip being coupled to the shaft at the butt end, and an average bending stiffness of a butt end portion of the shaft being greater than 4.9 times an average bending stiffness of a tip end portion of the shaft, wherein the tip end portion extends in a tip-to-butt direction from 150 mm from the tip end to 300 mm from the tip end, wherein the butt end portion extends in the tip-to-butt direction from 800 mm from the tip end to 950 mm from the tip end, and wherein a rate of change of bending stiffness in a tip-to-butt direction, at a point along a middle portion between the tip end portion and the butt end portion, is at least 2.7 times an average rate of change of bending stiffness of the butt end portion.

2. The golf club of claim 1, wherein the average bending stiffness of the butt end portion of the shaft and the average bending stiffness of the tip end portion of the shaft satisfy the following inequality:

$$BS \geq 4.32TS - 64.8 \ \frac{\text{kg}}{\text{in}},$$

wherein BS is the average bending stiffness of the butt end portion of the shaft, and TS is the average bending stiffness of the tip end portion.

3. The golf club of claim 1, wherein a mass of the shaft is less than 55 g, and a mass of the grip is less than 45 g.

4. The golf club of claim 3, wherein the mass of the shaft is less than 50 g, and the mass of the grip is less than 40 grams, and wherein a mass ratio of the mass of the shaft to the mass of the grip is within a range of 1.0 to 1.5.

5. The golf club of claim 4, wherein the mass ratio is within a range of 1.1 to 1.3.

6. The golf club of claim 3, wherein a diameter of the shaft at the tip end is less than 0.315 inches.

7. The golf club of claim 1, wherein a greatest rate of change of bending stiffness in the tip-to-butt direction in the shaft between 300 mm from the tip end and 800 mm from the tip end is at least 2.0 kg/(in*mm).

8. A golf club comprising:

a golf club head;

a grip; and a shaft having a tip end and a butt end, the golf club head being coupled to the shaft at the tip end, and the grip being coupled to the shaft at the butt end, wherein the shaft includes:

a tip end portion that extends in a tip-to-butt direction from 150 mm from the tip end to 300 mm from the tip end;

a butt end portion that extends in the tip-to-butt direction from 800 mm from the tip end to 950 mm from the tip end and has an average rate of change of bending stiffness in the tip-to-butt direction; and a middle portion between the tip end portion and the butt end portion, a rate of change of bending stiffness in the tip-to-butt direction at a point along the middle portion being at least 2.7 times the average rate of change of bending stiffness of the butt end portion.

9. The golf club of claim 8, wherein the rate of change of the bending stiffness at the point along the middle portion is at least 3.5 times the average rate of change of bending stiffness of the butt end portion.

10. The golf club of claim 8, wherein the middle portion extends in the tip-to-butt direction from 600 mm from the tip end to 800 mm from the tip end.

11. The golf club of claim 8, wherein a diameter of the shaft at the tip end is less than 0.315 inches.

12. The golf club of claim 11, wherein the diameter of the shaft at the tip end is less than 0.300 inches.

13. The golf club of claim 12, wherein the diameter of the shaft at the tip end is within a range of 0.250 inches to 0.285 inches.

14. The golf club of claim 12, wherein a mass of the shaft is less than 50 g, a mass of the grip is less than 40 grams, and a mass ratio of the mass of the shaft to the mass of the grip is between 1.0 to 1.5.

15. A golf club comprising:

a golf club head;

a grip; and a shaft having a tip end and a butt end, the golf club head being coupled to the shaft at the tip end, and the grip being coupled to the shaft at the butt end, wherein a difference in bending stiffness in the shaft between a point at 800 mm from the tip end and a point at 600 mm from the tip end is at least 250 kg/in.

16. The golf club of claim 15, wherein the difference in bending stiffness is at least 300 kg/in.

17. The golf club of claim 15, wherein a diameter of the shaft at the tip end is less than 0.300 inches.

18. The golf club of claim 15, wherein a mass of the shaft is less than 50 g, a mass of the grip is less than 40 g, and a mass ratio of the mass of the shaft to the mass of the grip is within a range of 1.1 to 1.3.

19. The golf club of claim 15, wherein the golf club head is a metal-wood type golf club head having a club head frontmost point and a club head rearmost point, and the golf club head comprising:

a striking face, the striking face defining the frontmost point;

a sole connected to a bottom side of the striking face, the sole having a rearmost point and a closing ascent angle of less than 35 degrees, wherein the closing ascent angle is:

an angle between (1) a line from the rearmost point of the sole to a sole point, of a projected silhouette of the golf club head from a toe-side viewpoint, located one third a front-to-back length from the club head rearmost point, as measured along a ground plane, and (2) a plane intersecting the sole point and parallel to the ground plane; and a crown connected to a topside of the striking face, the crown including a rearmost point and a closing descent angle of less than 35 degrees, wherein the closing descent angle is:

an angle between (1) a line from the rearmost point of the crown to a crown point, of the projected silhouette of the golf club head from the toe-side viewpoint, located one third a front-to-back length from the club head rearmost point, as measured along a ground plane, and (2) a plane intersecting the crown point and parallel to the ground plane; and within 85%-115% of the closing ascent angle of the sole.

* * * * *